United States Patent [19]

Scherbatskoy

[11] Patent Number: 4,689,775

[45] Date of Patent: Aug. 25, 1987

[54] DIRECT RADIATOR SYSTEM AND METHODS FOR MEASURING DURING DRILLING OPERATIONS

[76] Inventor: Serge A. Scherbatskoy, 3921 Clayton Rd. E, Fort Worth, Tex. 76116

[21] Appl. No.: 403,429

[22] Filed: Jul. 30, 1982

Related U.S. Application Data

[60] Continuation-in-part of Ser. No. 110,848, Jan. 10, 1980, which is a division of Ser. No. 857,677, Dec. 5, 1977, abandoned.

[51] Int. Cl.[4] ..... G01V 1/40

[52] U.S. Cl. ..... 367/83; 175/48; 73/151

[58] Field of Search ..... 367/81, 83; 340/861; 181/119, 121; 33/306, 307; 175/40, 48, 50; 324/356; 73/153, 151, 152

[56] References Cited

U.S. PATENT DOCUMENTS

| | | | |
|---|---|---|---|
| Re. 30,246 | 4/1980 | Richter, Jr. et al. | 73/152 |
| 3,223,183 | 12/1965 | Varney | 175/40 |
| 3,302,457 | 2/1967 | Mayes | 367/83 |
| 3,302,573 | 2/1967 | Ledeen | 310/11 |
| 3,805,606 | 4/1974 | Stelzer et al. | 73/152 |
| 3,867,714 | 2/1975 | Patton | 175/40 |
| 3,908,770 | 9/1975 | Richter, Jr. et al. | 73/152 |
| 3,997,867 | 12/1976 | Claycomb | 367/83 |
| 4,033,429 | 7/1977 | Farr | 181/120 |
| 4,134,100 | 1/1979 | Funke | 181/119 |
| 4,147,223 | 4/1979 | Patton | 175/40 |
| 4,224,687 | 9/1980 | Claycomb | 367/83 |
| 4,260,030 | 4/1981 | Fox . | |
| 4,276,943 | 7/1981 | Holmes | 367/83 |
| 4,291,395 | 9/1981 | Holmes | 367/83 |
| 4,323,991 | 4/1982 | Holmes et al. | 367/83 |
| 4,351,400 | 9/1982 | Faulkner | 175/69 |
| 4,394,880 | 7/1983 | Faulkner | 175/69 |
| 4,562,560 | 12/1985 | Kamp | 367/83 |

FOREIGN PATENT DOCUMENTS

| | | | |
|---|---|---|---|
| 2375432 | 8/1978 | France | 367/83 |

*Primary Examiner*—Thomas H. Tarcza
*Assistant Examiner*—Ian J. Lobo
*Attorney, Agent, or Firm*—Head Johnson Stevenson

[57] ABSTRACT

A system for use in providing measurements from within a borehole to the earth's surface during drilling operations in which a drill pipe extends from the earth's surface having a drilling means, such as a drill bit, at the lower end and a fluid circulation system forming a column of drilling fluid within the drill string, a direct radiator telemetering system including a housing positioned within the drill string providing for the flow of drilling fluid therepast, the housing being in the form of a tubular member having within it an electrically driven pressure pulse radiating means responsive to electrical signals representing the magnitude of a downhole parameter for producing a sequence of pressure pulses indicative of the magnitude, the tubular housing being of a relatively long length being of approximately a substantial fraction of the equivalent wavelength of the pulses produced by the pulse producing means, and instruments at the earth's surface for maintaining superatmospheric mud pressure in the top of the drill string and for detecting the pressure pulses to provide a measure of the magnitude of the parameter.

21 Claims, 25 Drawing Figures

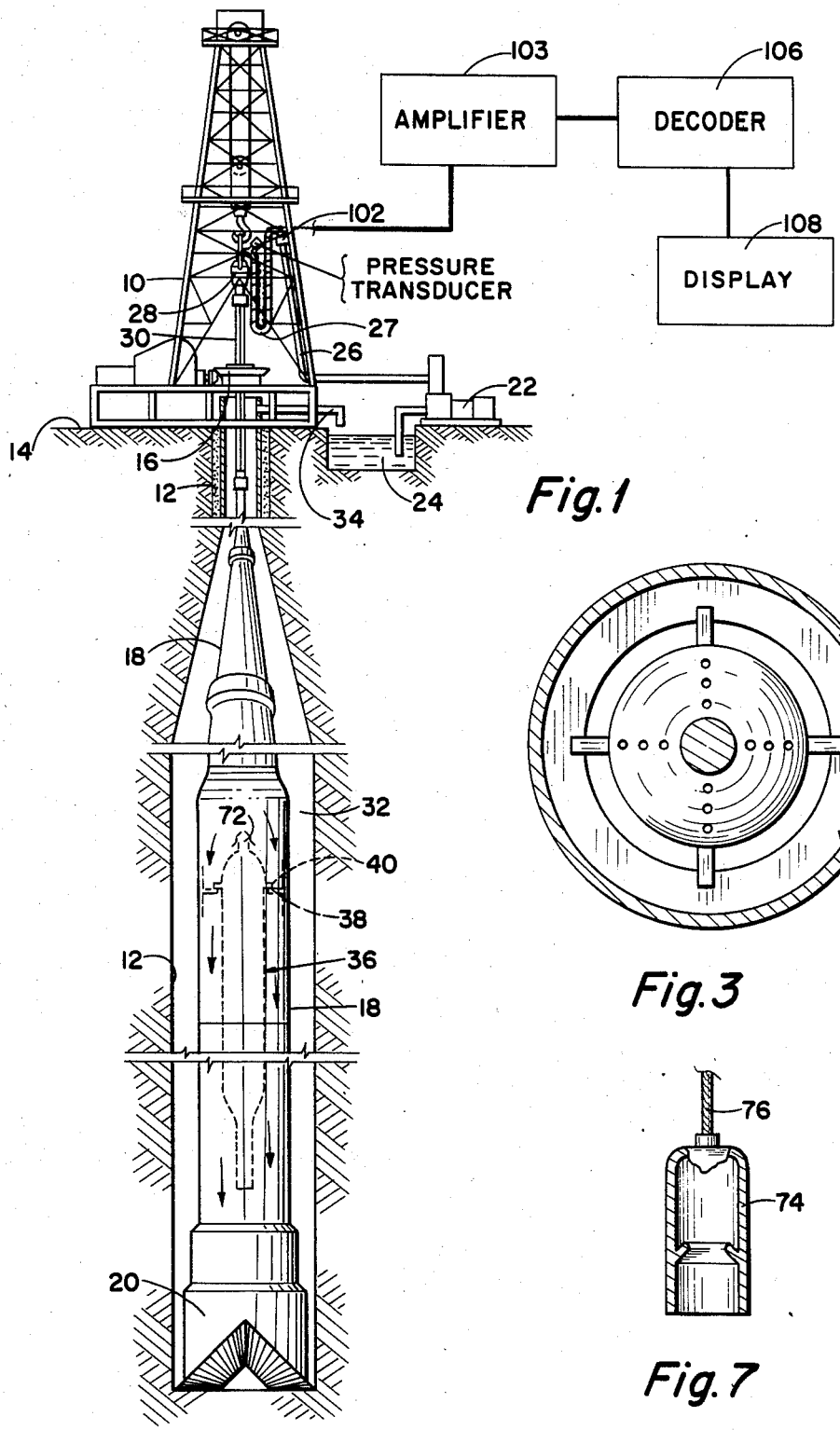
Fig. 1
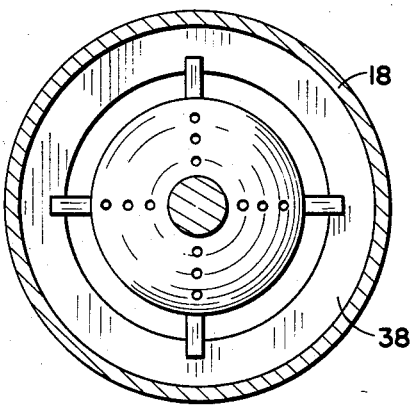
Fig. 3
Fig. 7

DIRECT RADIATOR SYSTEM AND METHODS FOR MEASURING DURING DRILLING OPERATIONS

CROSS-REFERENCE TO RELATED APPLICATION

This application is a continuation-in-part of a copending application, Ser. No. 110,848 filed by Serge A. Scherbatskoy on Jan. 10, 1980 entitled: "IMPROVED SYSTEMS, APPARATUS AND METHODS FOR MEASURING WHILE DRILLING", which is a division of U.S. patent application Ser. No. 857,677, filed Dec. 5, 1977, now abandoned.

SUMMARY OF THE INVENTION

Since the advent of drilling boreholes for oil and gas, it has been a desire of drilling operators to have available information as to conditions at or near the bottom of the borehole. The conditions can be accurately determined by instruments suspended on a wire line into the borehole, but this requires the drill string to be removed from the borehole, or, if the instruments are run within the interior of the borehole, then the cable carrying the signals must be threaded through each joint of drill pipe as it is added to the drill string. Others have suggested means for transmitting information from within a borehole to the earth's surface by the use of mud pressure pulses produced by varying the rate of flow of the mud.

Two basic methods have been employed for generating mud pressure pulses in the drilling fluid column within a drill string. The first method is that of producing positive pulses which can be achieved by temporarily interrupting the flow, or at least a portion of the flow, of drilling fluid within the column. The other basic system is to create a negative pulse in the fluid column which can be achieved by momentarily increasing the rate of fluid flow in the column. This can be achieved by temporarily reducing the restriction to the flow of fluid through the column or by momentarily bypassing a portion of the drilling fluid within the drill string to the annular area between the drill string and the borehole. The basic concept of providing positive pressure pulses by temporarily interrupting or reducing the downward flow of drilling fluid within the drill string has been suggested such as by U.S. Pat. No. 2,759,143 to Arps; U.S. Pat. No. 3,736,558 to Cubberly; and U.S. Pat. No. 3,711,825 to J. R. Claycomb. These are merely exemplary of prior art devices which show the transmission of information utilizing positive pressure pulses. The concept of employing negative pressure pulses has been taught in U.S. Pat. No. 3,983,948 to Jeter and U.S. Pat. No. 2,887,298 to Hampton. Canadian Pat. No. 1,124,228 to S. A. Scherbatskoy illustrates the provision of the negative mud pressure system as taught in the Jeter patent.

At the present time Measuring While Drilling (MWD) techniques are employed commercially by Gearhart Industries, Inc. of Fort Worth, Tex. and by others in which apparatus is inserted into a length of drill string above the drilling tool. These systems transmit information employing mud pressure pulses and have worked successfully. One disadvantage with the present measuring while drilling system is that the pulser must be secured within specially prepared drill string subs before the sub is inserted as a part of the drilling string; that is, the presently used mud pulse telemetry systems for transmitting information during drilling operations have to be inserted into the drill string as it is assembled and cannot be removed until the entire drill string is pulled from the well.

Another disadvantage of the present MWD systems is that they function by interrupting or changing the direction of at least a portion of mud flow, which require valving and sealing operations. Drilling fluid is inherently abrasive. Thus any type of valve function which includes a flow path for drilling fluid which is opened or closed, whether for creating positive pressure pulses or creating negative pressure pulses, includes the use of devices which are subject to a high rate of wear and possible leakage. For this reason, the operating life of mud pulse producing devices of the type employed today is relatively short. In addition, when valving operations are required it is inherently necessary that the structures accomplishing the valving operations be accurately fitted and sealed relative to each other, and this makes it exceedingly difficult to have a valving type mud pressure signalling system which is readily insertable into or removable from the interior of a length of drill string without first removing the drill string from the borehole.

The present invention is directed towards a mud pressure pulse signalling system for use in providing measurements while drilling which produces discrete pressure pulses without employment of a valving function, that is, wherein the rate of flow of the drilling fluid is not employed as a means of producing pressure pulses. Instead, the present invention employs the use of a direct radiator concept in which pressure pulses are produced within a housing, preferably in the form of a tubular member of an external diameter less than the internal diameter of the portion of the drilling string in which the housing is positioned. Within the tubular housing a pulse producing means is provided, such as a piston or diaphragm. Drilling fluid does not flow through the interior of the housing. The pressure pulses are produced by the actuation of the pulse producing means, either piston or diaphragm, without changing the rate of fluid flow of drilling fluid past the housing within the drill string.

In order to ensure signal propagation of a pulse within the drilling fluid it is important that the pulse not be cancelled by a corresponding pressure pulse of opposite polarity. For this reason the present invention provides, as one embodiment, the utilization of a tubular housing having a length which is a selected fractional portion of the wavelength or bears a predetermined relationship with the equivalent wavelength of the pressure pulse produced. In a preferred arrangement the tubular housing is of an acoustical equivalent length corresponding to approximately one-fourth of the wavelength or the equivalent of the wavelength of the pulse produced.

An advantage of the invention is that since no valving functions are required the downhole tool can easily be inserted into or removed from a drill string by means of a latch mechanism and cable extending from the earth's surface. This advantage allows the bottom hole portion of the signalling system to be removed for repair if it becomes defective. In addition, it permits the insertion of the bottom hole portion of the signalling system into a drill string at any time since the tool can be inserted into the drill string by means of a latch mechanism and disengageable cable extending from the earth's surface without the necessity of removing the drill string from the borehole.

The invention also provides equipment and methods for use at the earth's surface to ensure a low impedance fluid transmission path from the downhole pulse producing tool to a pulse receiver at the surface when the normal mud pump is stopped. In addition, the invention provides means of improved signal extraction techniques when measurements are made when the mud pump is running.

The differences between the present invention and the prior art, as well as the advantages which accrue from the use of the present invention, will become more apparent from a reading of the following description and claims, taken in conjunection with the attached drawings.

BRIEF DESCRIPTION OF THE VIEWS

FIG. 1 is a diagrammatic representation of a drilling system including a drilling rig supported on the earth's surface with a mud circulation system and a drill string extending downwardly in a borehole in the earth, the lower portion of the borehole and drill string being greatly enlarged compared to the upper portion of the drawing, the lower portion showing the employment of a direct radiator transmitter for the measuring while drilling (MWD) system of this invention. The apparatus used at the earth's surface for detecting mud pressure pulses and for providing a measure of the magnitude of a downhole parameter is shown in block diagram form.

FIG. 3 is a cross-sectional view taken along the line 3—3 of FIG. 2.

FIG. 7 is an elevational cross-sectional diagrammatic view of a device affixed to the end of a cable which can be employed for removing and/or inserting a direct radiator MWD tool into a drilling string by means of a disengageable cable extending from the earth's surface.

Figure 8:
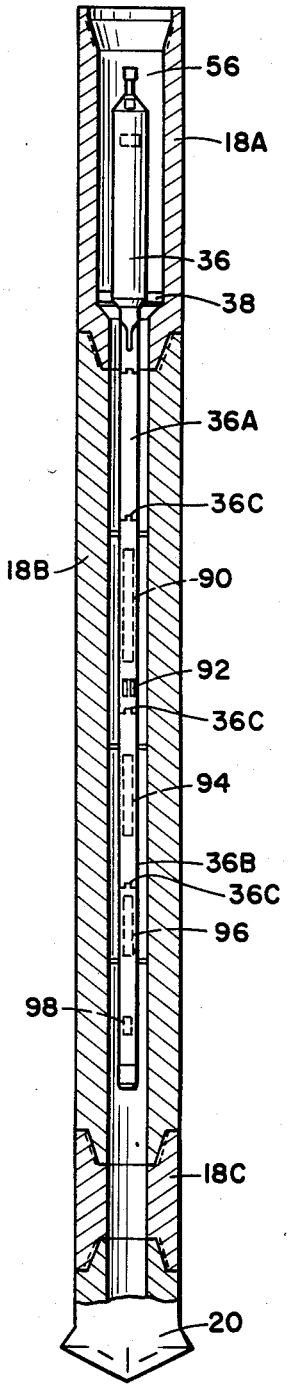

FIG. 8 is an elevational cross-sectional view of a length of drill string showing, at the upper end, a special sub having the pulse producing housing of the present invention positioned therein, and showing a drill collar and a bit at the lower end thereof, with the lower housing of the instrument of the present invention being supported in indexed and dependent fashion in the drill collar below the special sub.

Figure 9:
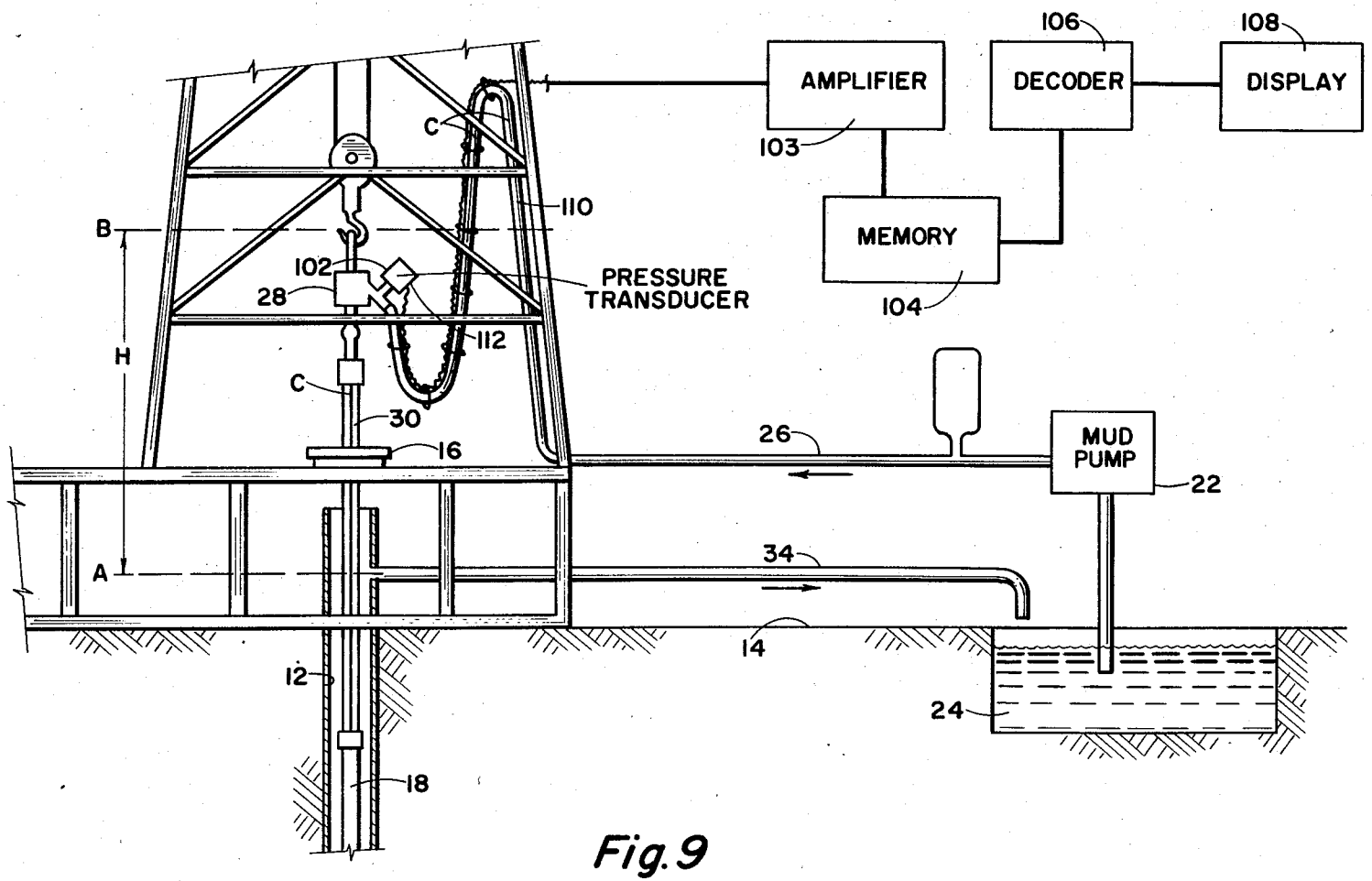

FIG. 9 is a diagrammatic illustration of the operation of drilling equipment illustrating one method of practicing the invention to transmit signals from within a borehole to the earth's surface.

Figure 10:
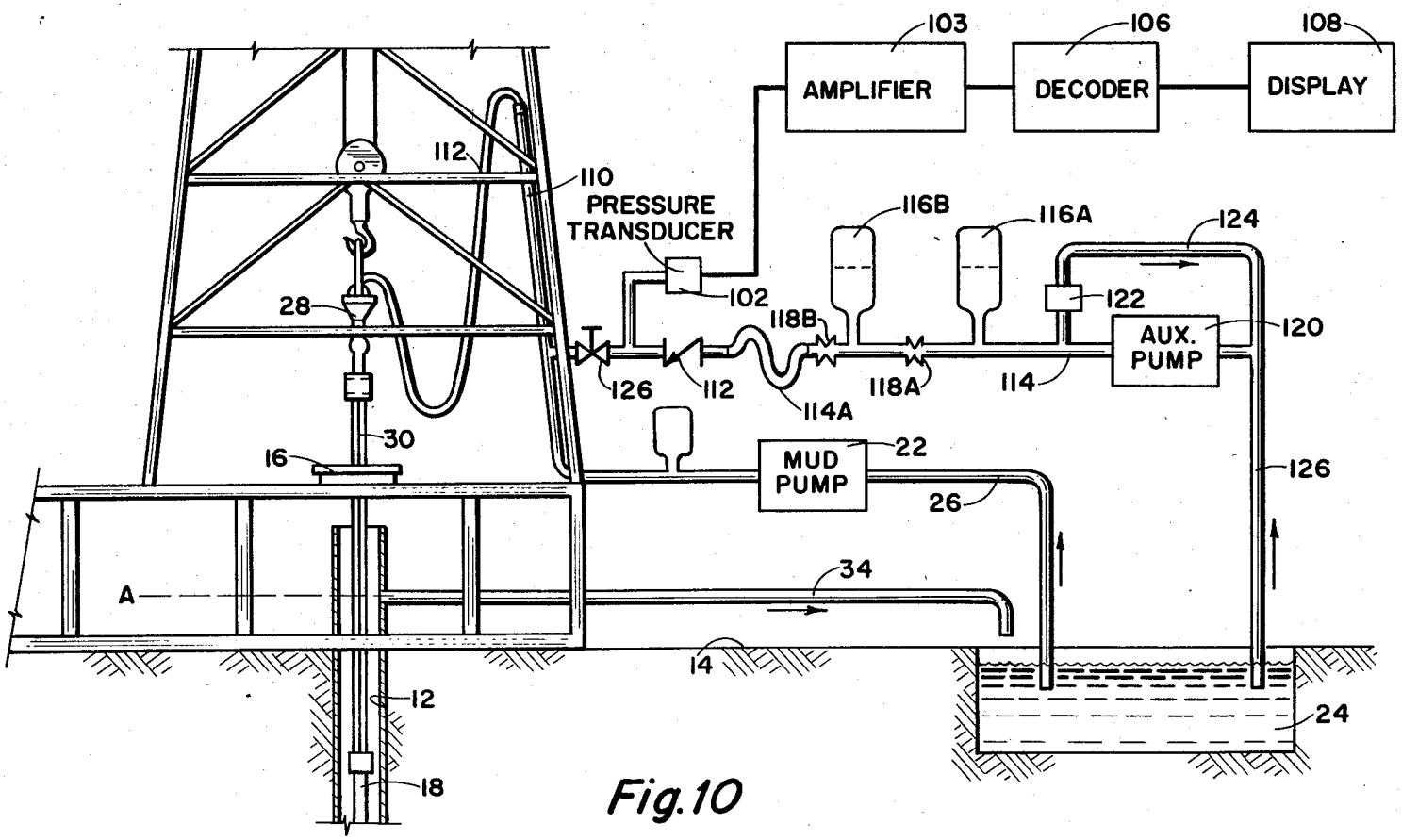

FIG. 10 is a diagrammatic illustration of equipment for operation of the apparatus of this invention in a manner to ensure that a low impedance path for the propagation of pressure signals from within the borehole to the earth's surface is maintained.

Figure 11:
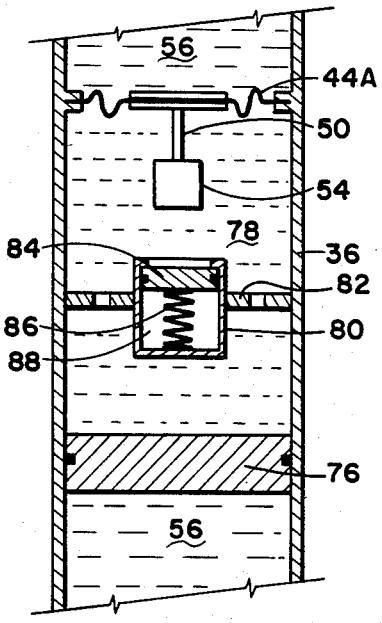

FIG. 11 is a fragmentary cross-sectional view of a portion of the pulser housing of an MWD instrument showing one method of pressure generation by means of a diaphragm type signal radiator and means of absorbing or silencing counter pressure signals.

Figure 12:
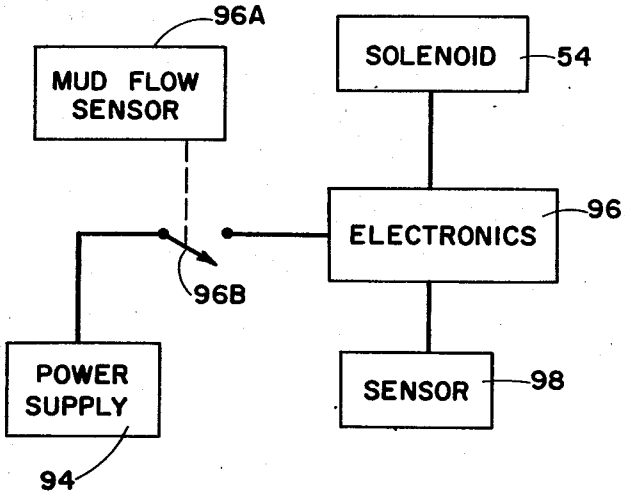

FIG. 12 is a block diagram of instrumentation which will be employed at the downhole MWD equipment for activating or interrogating the equipment so that information will be transmitted to the earth's surface.

Figure 13:
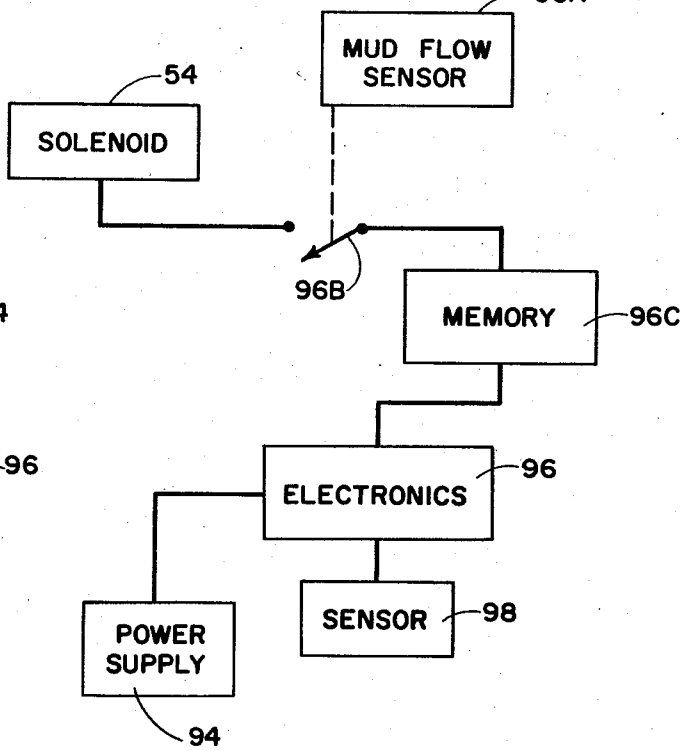

FIG. 13 is a block diagram of an alternate arrangement of instrumentation as described with reference to FIG. 12, in which a memory is employed to store information which is later transmitted to the earth's surface in response to a command sent from the surface.

Figure 14:
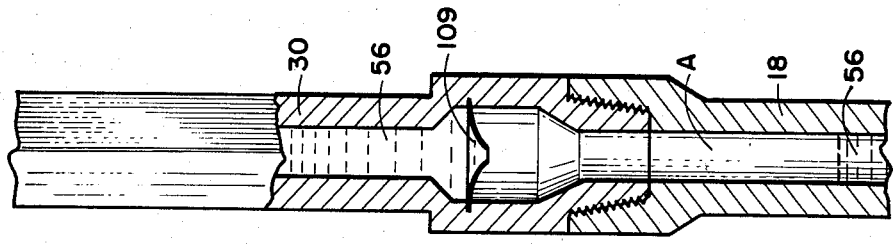

FIG. 14 is a fragmentary cross-sectional view of the lower end of a kelly and a Mud Check Kelly Valve secured to the lower end of the kelly showing how a checking action may be introduced below the kelly when the mud pumps are stopped.

Figure 15:
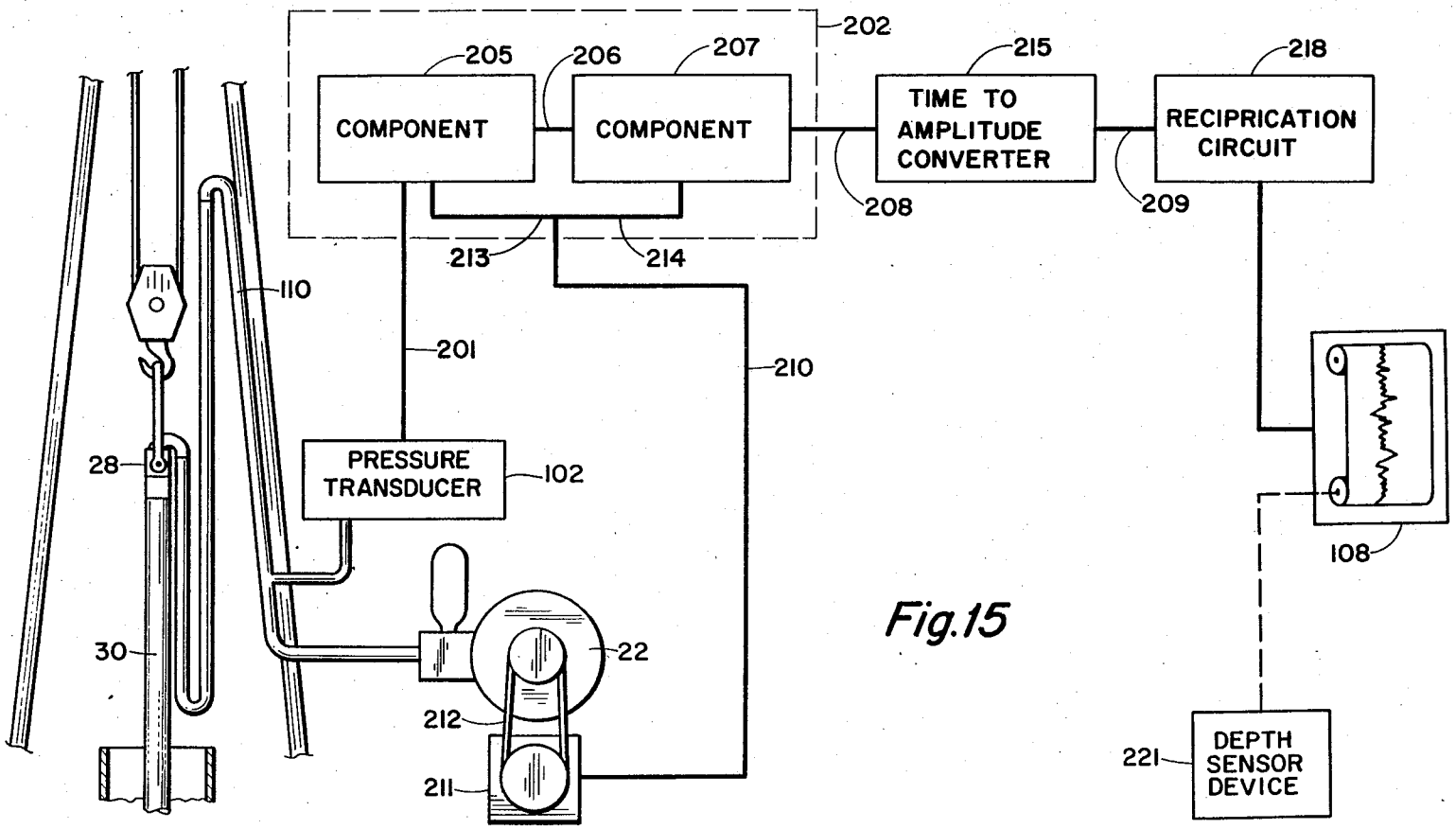

FIG. 15 is a schematic illustration showing typical aboveground equipment for extracting a signal transmitted from within the borehole, when the measurements are made while the pump is operating and when the downhole parameter being measured is radioactivity.

Figure 16:
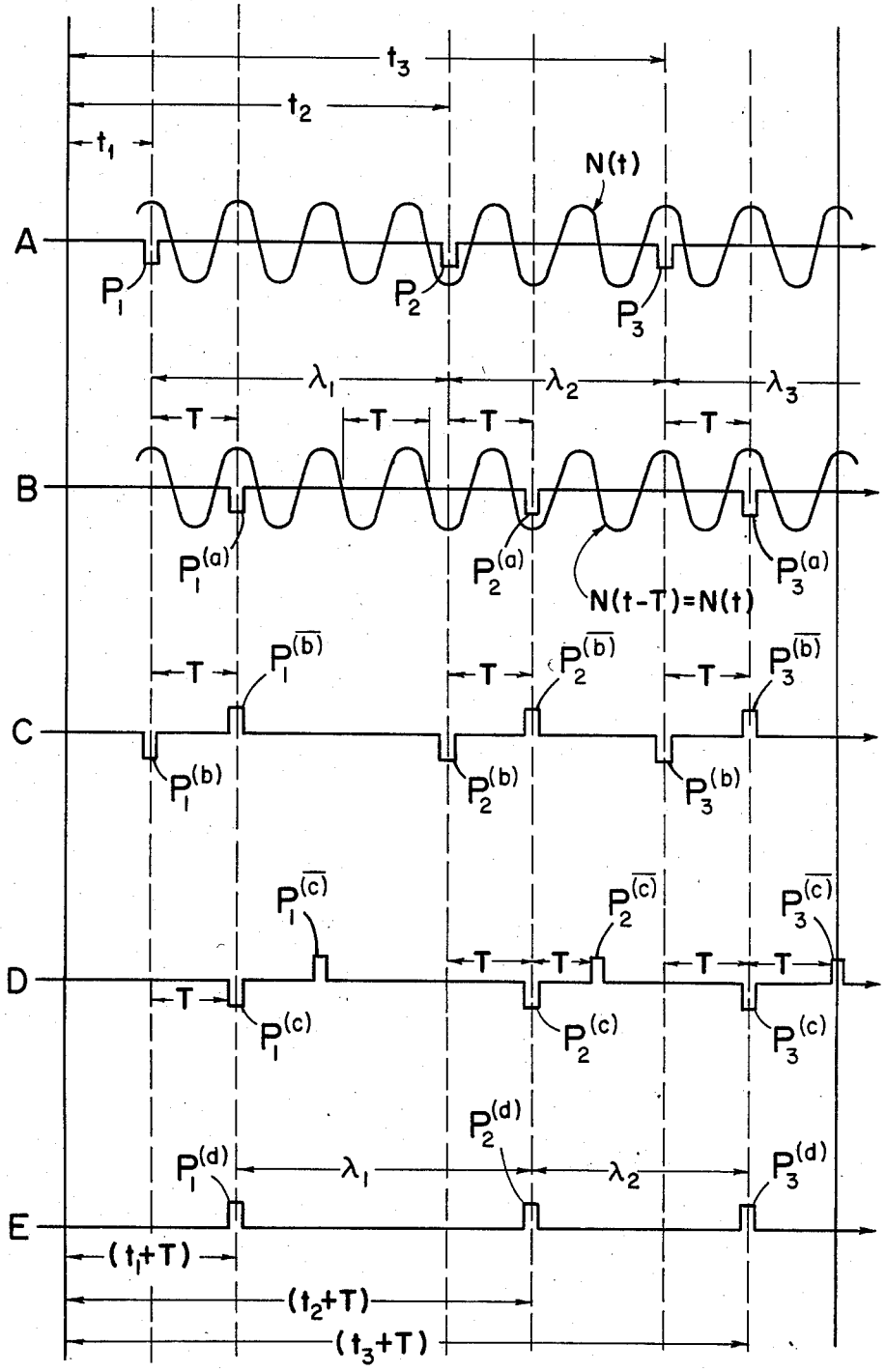

FIG. 16 is a graphic illustration, in idealized form, showing certain wave forms and pulses and time relationships to aid in explanation of the signal extraction portion of FIG. 15

Figure 17:
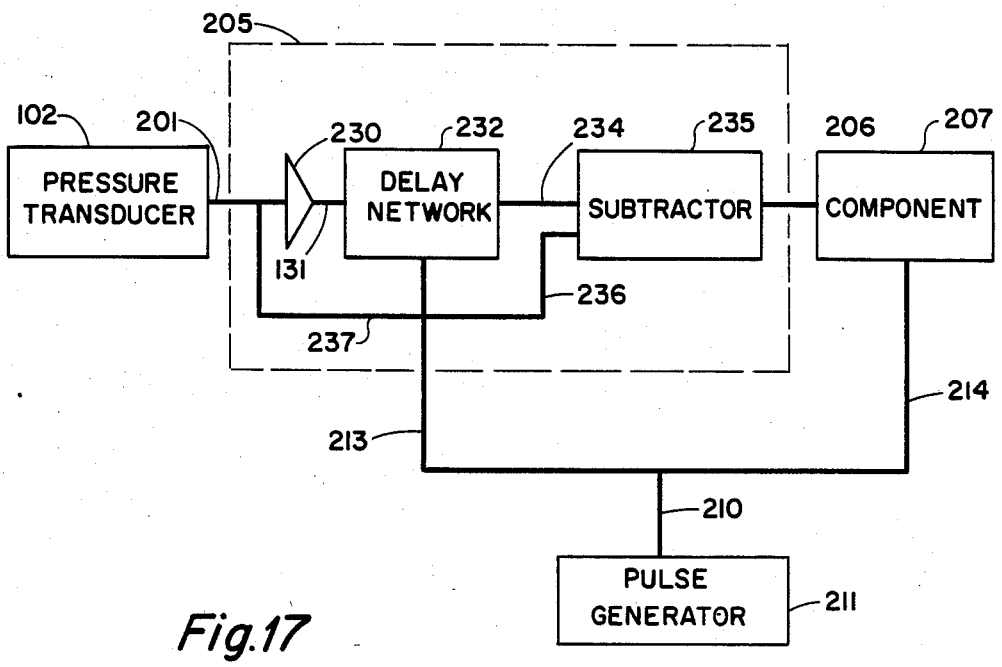

FIG. 17 is a schematic block diagram showing a component of the signal extractor of FIG. 15 in further detail.

Figure 18:
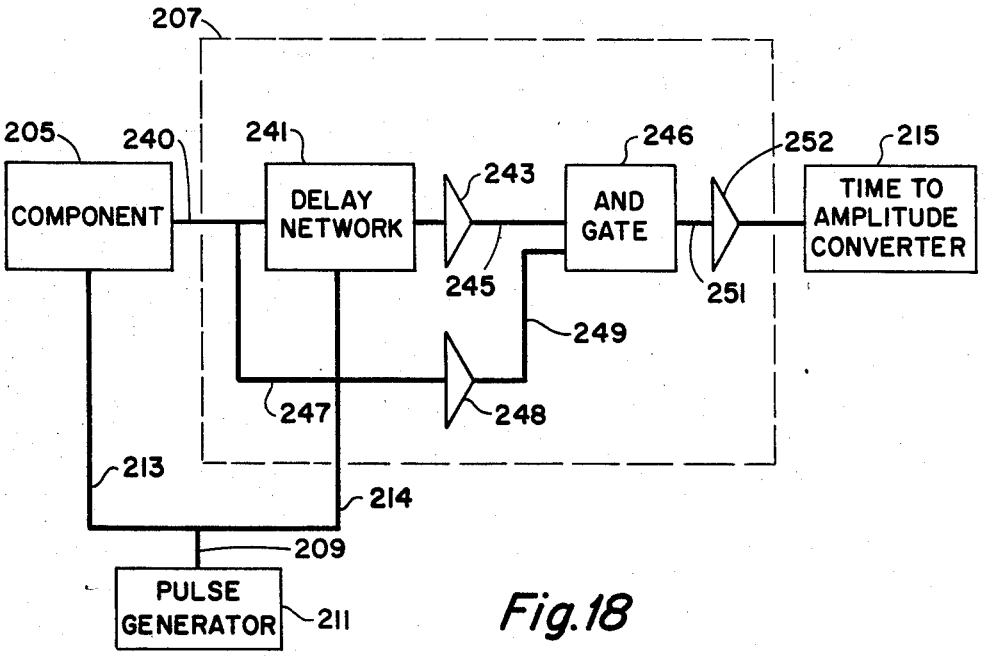

FIG. 18 is a schematic block diagram showing a component of the signal extractor of FIG. 15 in further detail.

Figure 19:
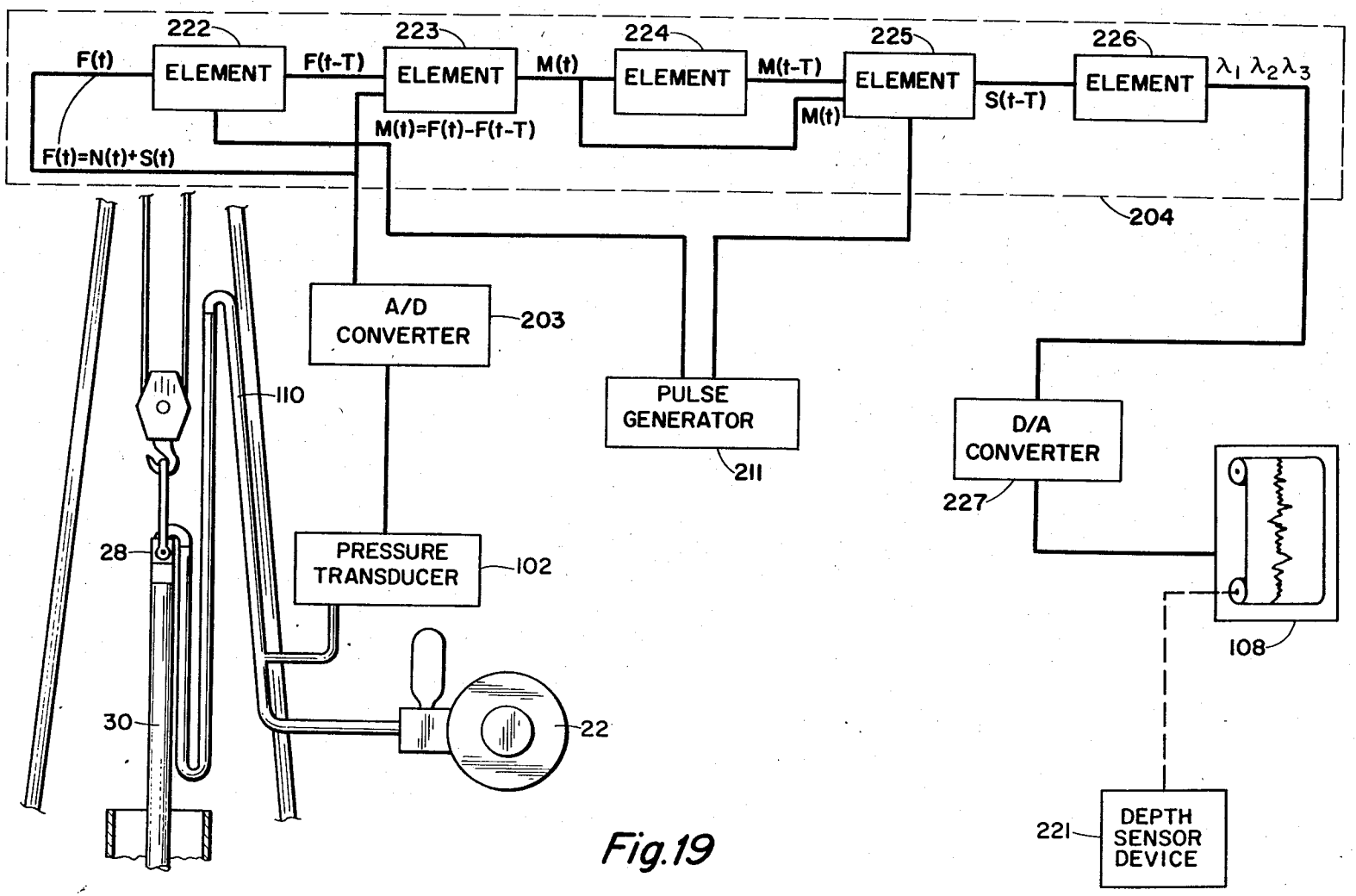

FIG. 19 is a schematic block diagram showing another form of aboveground equipment that may be utilized.

Figure 20:
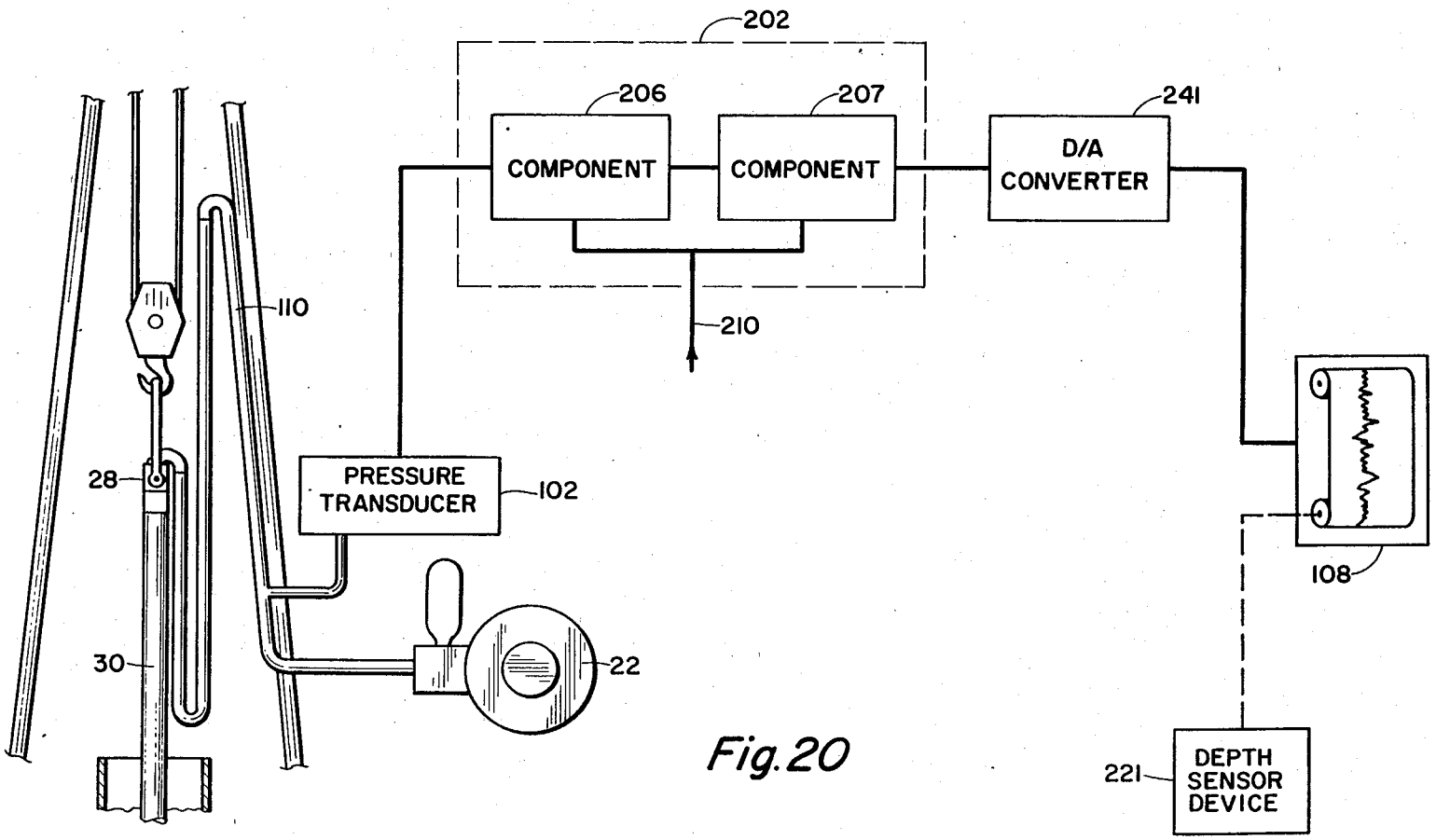

FIG. 20 is a schematic block diagram showing still another form of aboveground equipment that may be utilized.

Figure 21:
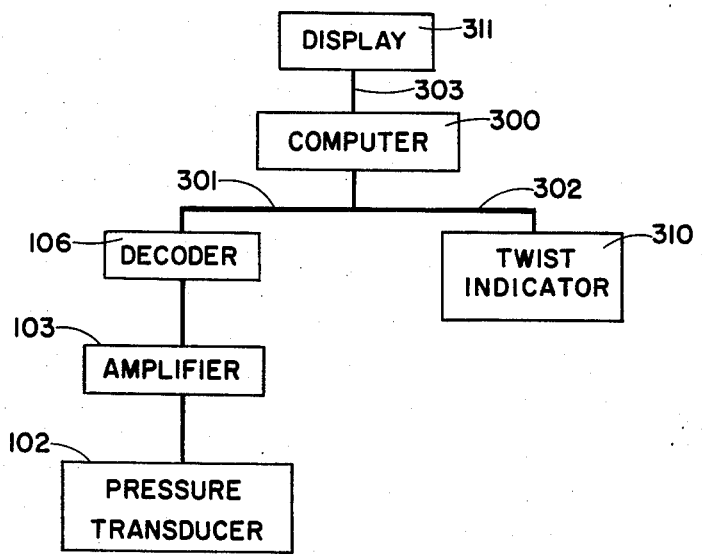

FIG. 21 is a schematic block diagram showing the equipment to be used in directional drilling in accordance with my invention.

DETAILED DESCRIPTION

Referring to the drawings and first to FIG. 1, the numeral 10 indicates a drilling rig for use in drilling a borehole 12 from the earth's surface 14 for purposes of producing oil and gas. The drilling system includes a rotary table 16 which turns a drill string 18 extending to a drilling means such as a drill bit 20. In some systems, rather than a rotary drill string 18, a non-rotating string may be employed wherein the lower end of the string includes a turbo drill or mud motor which rotates the drill bit 20. Either system employs a drilling fluid circulation system which typically includes a pump 22 which pumps drilling fluid from a reservoir or mud tank 24 through a standpipe 26, hose 27 and swivel 28 connected to a drilling kelly 30. The lower end of the kelly connects to the drill string 18. In drilling operation fluid is circulated by pump 22 through the standpipe 26, kelly 30, and down the interior of the drill string 18. It passes out through jets (not shown) in bit 20 and flows back up the annular area 32 to the earth's surface and out pipe 34 back into the mud tank 24. Attached to the swivel 28 is a small pressure transducer 102 which is connected to the fluid carrying interior of the swivel 28 by a suitable drilled passageway. The pressure transducer 102 produces an electrical voltage proportional to the fluid pressure in the interior of the swivel 28. It connects to an amplifier 103 by wires that are suitably clamped to the hose 27.

Except for the provision of the small pressure transducer 102, the drilling system described to this point is a standard system employed in the petroleum industry for drilling oil and gas wells. The function of the present invention is to provide means of detecting information adjacent the bottom of the borehole 12, such as temperature, pressure, borehole inclination, azimuth, radioactivity, etc. and transmitting the information so that it is available at the earth's surface during drilling operations. As previously described, others have provided systems for accomplishing this result, some of which have functioned successfully. The present invention has advantages over the known prior art systems.

The bottomhole telemetering system of FIG. 1 includes a housing generally indicated by the numeral 36 which is positioned within a section of drilling string 18 above bit 20. The section of drilling string in which the housing 36 is received preferably includes a means 38 which is known as a "mule shoe" and acts as a seat for holding the housing 36 and indexing it with respect to the drill string 18 and the sub 18A (See FIG. 8). The housing 36 has an external portion 40 which rests on the internal flange 38 of the mule shoe by which the housing can be supported at a proper position within the drill string. This is by way of illustration only in a diagrammatic manner, but it can be seen that a variety of different arrangements may be made for retrievably and removably supporting a housing within a special section of the drill string. The internal and external flanges 38 and 40 are arranged such that the flow of drilling fluid, as indicated by the arrows, is not significantly impeded either by the housing 36 or the manner of supporting the housing within the drill string.

Figure 2:
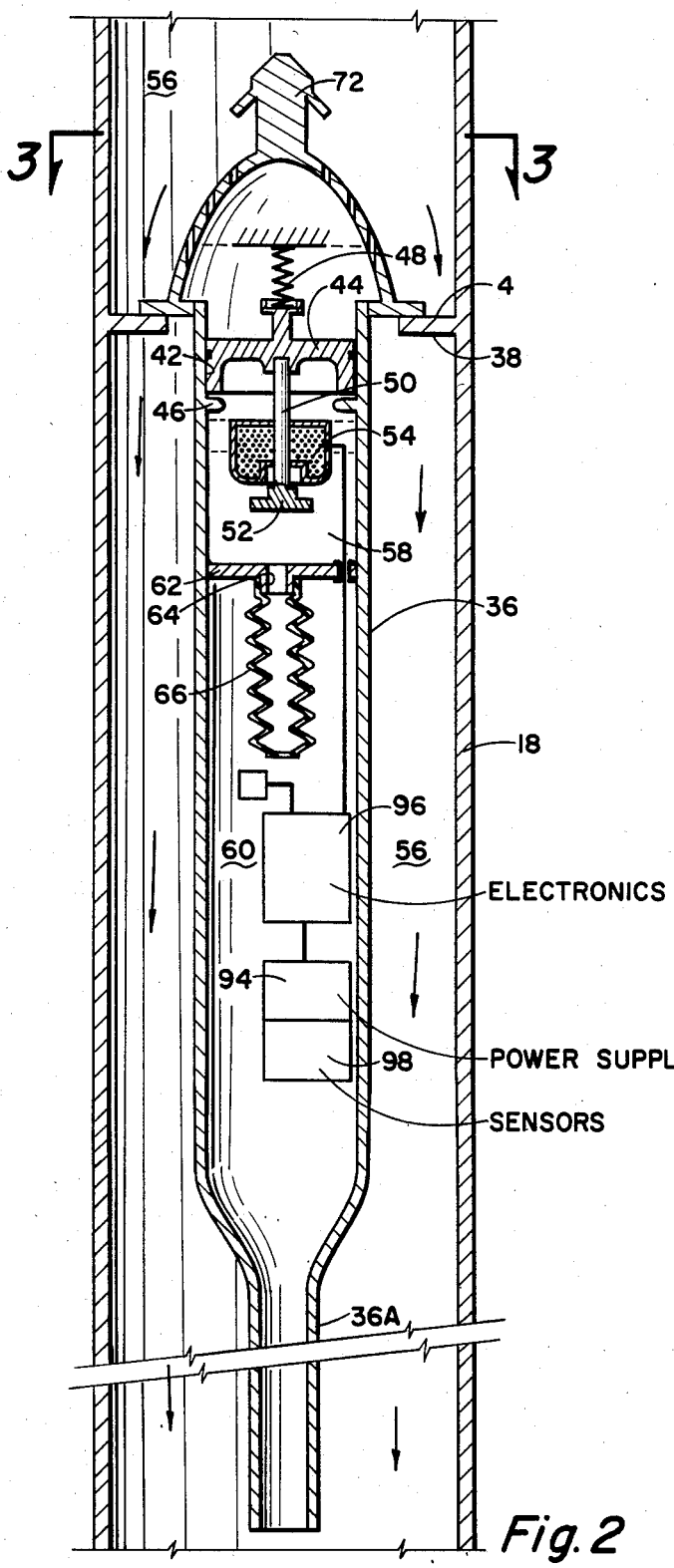
FIG. 2 is an enlarged elevational cross-sectional view of a direct radiator MWD system of this invention in which a piston functioning inside a cylinder in a housing is employed for producing mud pressure pulses at the bottom of a borehole during drilling operations.

Referring now to FIG. 2, an embodiment of the invention showing more details of the housing 36 is shown. The housing is preferably tubular and elongated and of an external diameter somewhat less than the internal diameter of the drill string and considerably less than the internal diameter of the special sub 18A providing ample room for the flow of drilling therepast as indicated by the arrows. Unlike other types of devices for transmitting signals in drilling fluid, the drilling fluid does not flow through the interior of tubular housing 36.

Formed within the lower portion 36B (see FIG. 8) of tubular housing 36 is one or several sensors 98 for sensing the value of one or several downhole parameters, batteries (or any suitable power supply) 94, and instrumentation 96. While the batteries, instrumentation, and sensors may be contained in the housing 36 as shown in FIG. 2, there are advantages in placement of these elements in the lower housing portion 36B so as to permit special sub 18A (see FIG. 8) to be relatively short.

Various types of sensors that generate electrical signals indicative of a downhole parameter are well known. Examples are gamma ray sensors, temperature sensors, pressure sensors, gas content sensors, strain gauge inclinometers, and many others.

When deviated or inclined wells are drilled, a turbine or "mud motor" such as a Dynadrill manufactured by Smith Industries, Inc., Houston, Tex., is frequently employed. In such case the drill string 18 of FIG. 1 is not rotated by the rotary table at the surface. The rotation to turn the bit 20 is derived from such a motor which usually is located immediately above the bit 20. In such case one of the sensors 98 may indicate the direction the drill bit is facing known in the trade as the "Tool Face".

The importance of this quantity in directional drilling will be discussed later in this specification.

In the sensors utilized in the present invention the magnitude of a downhole parameter is represented by electrical pulses. The sequence of the pulses is based on a code (binary or other).

The pulses generated by each of the sensors 98 are arranged to actuate (energize) a solenoid 54 provided with a plunger 52. Affixed to the plunger 52 is a piston rod 50 affixed to piston 44 within the cylinder 42. Piston 44 is normally held in a downward position against steps 46 by means of a compressor spring 48.

It can be seen that each single electrical pulse generated by a sensor 98 energizing the solenoid 54 produces a "positive displacement" of the piston 44, such a "positive displacement" being defined here as a motion of the piston upwards from its initial position followed by a motion downwards to its initial position. Such a positive displacement produces a positive increment in pressure in a region of space above the piston 44 and almost simultaneously a negative increment of pressure in the region of space below the piston 44. These localized positive and negative increments in pressure are centers of disturbances which generally speaking interfere one with another and tend to cancel unless special provisions are made to prevent cancellation. It should be noted that the positive increment in pressure is represented by a sudden increase and a subsequent decrease in pressure whereas a negative increment in pressure is represented by a sudden decrease in pressure and a subsequent increase in pressure.

It can also be seen that the solenoid 54 and spring 48 can equally well be arranged to produce a negative displacement of the piston 44, such a "negative displacement" being defined here as a motion of the piston 44 downwards from its initial position followed by a motion upwards to to the initial position. Such a negative displacement produces a negative increment in pressure at the top of the piston and almost simultaneously a positive pressure increment on the bottom side.

Figure 4:
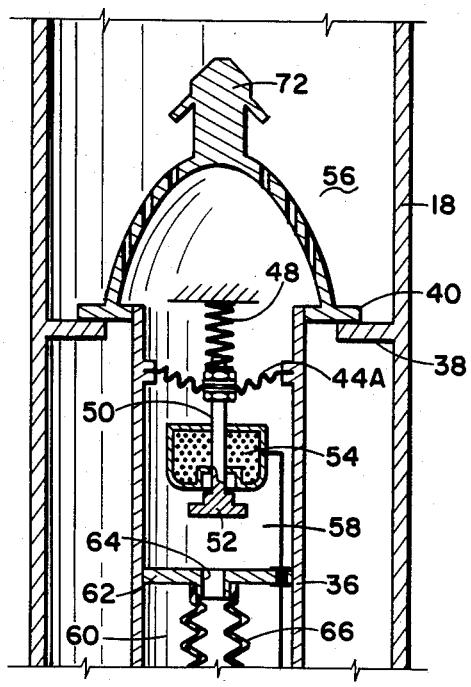
FIG. 4 is a fragmentary elevational cross-sectional view of a direct radiator MWD system as shown in FIG. 2 but showing the arrangement wherein pressure pulses are produced employing a diaphragm.

Referring to FIG. 4, an alternate embodiment of the invention is shown in which, instead of a piston as in FIG. 2, a diaphragm is employed for creation of the pressure increments. The diaphragm 44A is supported and sealed at its peripheral circumferential edge to the interior of pulser housing 36. The center of the diaphragm is attached to the piston rod 50 portion of the plunger of solenoid 54. Diaphragm 44A is normally deflected downwardly by spring 48 but is rapidly deflected upwardly by energization of solenoid 54, thereby producing the pressure increments. Alternatively, spring 48 may be employed to normally urge diaphragm 44A upwardly and solenoid 54 employed to move it rapidly downwardly when energized, to produce the pressure increments of opposite polarity.

To ensure operation and electrical insulation of solenoid 54, plunger 52, and piston rod 50, the interior portion 58 of the housing containing these elements is preferably filled with oil. Portion 58 is separated from the lower portions 60 of the housing by means of a partition wall 62 having an opening 64 therein. The sudden upward movement of piston 44 creates a pressure reduction in the fluid contained within the interior portion 58. To permit the free movement of this force, provision must be made for expanding and contracting the volume of portion 58. This can be achieved by means of a flexible impervious container or bellows 66 which is connected with opening 64. Container 66 will have on its interior the oil or liquid within the interior portion 58. When piston 44 of FIG. 2 or diaphragm 44A of FIG. 4 is displaced upwardly by actuation of solenoid 54, flexible container 66 partially collapses, allowing for equalization of pressure within space 58 with that in space 60. After the actuation of solenoid 54, when the voltage applied thereto is removed, the piston 44 (or diaphragm 44A) is returned to its rest position by means of spring 58, and the displaced fluid will pass from flexible container 66. Thus the pressure reduction produced by the upward movement of piston 44 is retained within the interior of housing 36 and passes into the housing portion 60.

In order to ensure the radiation of the pressure pulse produced by the displacement of piston 44, it is important that the housing 36 be designed in such a manner that the pressure increment at the top of piston 44 is not cancelled by a corresponding pressure increment of opposite sign produced on the underside of the piston. If the negative pressure increment in housing portion 60 is permitted to immediately pass into the well fluid 56 surrounding the portion of the housing containing piston 44, a portion of the pressure signal would be partly or totally cancelled. It is therefore important that the negative pressure increment be isolated from the positive pressure increment for a sufficient length of time to avoid partial or total cancellation and thus ensure the propagation of a positive pressure pulse upwardly within drill string 18 to the earth's surface. This can be accomplished by making the tubular housing 36 of a long length such as a selected fractional portion of the effective wavelength of the signal produced by displacement of piston 44. In the optimum embodiment the negative pressure increment produced by the sudden upward movement of piston 44 should be delayed by one-half wavelength, and therefore, the length of tubular housing 36 would be one-fourth wavelength. Assuming an important frequency component of the pressure pulse signal to be 10 hz. and assuming a velocity of propagation of 4,000 ft/sec. the wavelength then would be 400 feet, and therefore, if housing 36 is one-fourth wavelength long, then its length would be 100 feet. If the diameter of housing 36 is smaller, the velocity of propagation within the housing would be somewhat lower, and therefore, the housing could be somewhat shorter.

I have thus provided a means for minimizing the interference produced by the effect of the pressure increment produced at the underside of the piston 44 upon the effect of the pressure increment produced at the top of the piston. Consequently the arrangement herein described provides a means for generating a succession of pressure pulses downhole and transmitting such pulses through the mud column to the earth's surface. These pulses produced in the output of the pressure transducer 102 a coded sequence representative of the parameters being measured by the downhole sensors 96. This output is then transmitted through an amplifier 103 to a decoder 106 and provides at the display element 108 the information regarding the magnitudes of the parameter being sensed.

Figure 5:
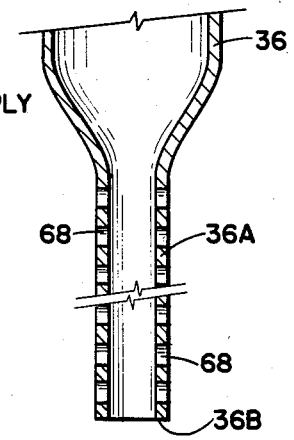
FIG. 5 is a fragmentary elevational cross-sectional view of the lower portion of a direct radiator MWD tool showing one means of attenuating the effect of a counteractive pressure pulse produced in the drilling fluid.

Another way of isolating the negative or rarefaction signal occurring in body 36 below piston 44 when a positive pressure signal is to be transmitted is by means of a silencer or muffler such as exemplified in FIGS. 5 or 6. In FIG. 5 the housing lower portion 36A has a plurality of small diameter openings 68 above the housing lower end 36B. By providing the large number of openings, the rarefaction or negative pressure pulse is slowly dissipated into the drilling fluid externally of the housing so as to thereby permit the effective tranmission of the positively created pulse to the earth's surface.

Figure 6:
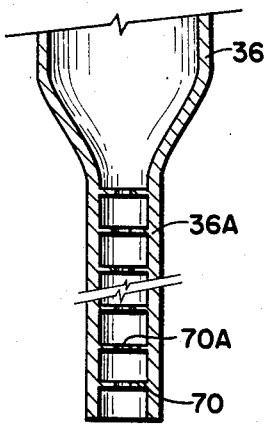
FIG. 6 is a fragmentary elevational cross-sectional view of a lower portion of a direct radiator MWD system as shown in FIG. 5 but showing an alternate arrangement for attenuating the counteractive pressure pulse.

FIG. 6 illustrates a type of muffler or silencer wherein the reduced diameter housing lower portion 36A includes a series of spaced apart internal flanges 70, each having a small diameter opening 70A therein. Such a device is similar to a 37 Maxim Silencer" as manufactured by Riley-Beard division of the U.S. Riley Corporation, Shreveport, La. U.S.A. This type of Maxim Silencer is best known when attached to a tight-breech firearm such as a rifle—it checks the sudden liberation of gases into the atmosphere by imparting a whirling motion to them. This whirling motion causes the gases (in our case well fluid) to fly out from the central hole by centrifugal force. The actual escape does not occur until later at which time the escape is slow and noiseless. The same mechanism that causes the whirling motion also serves as a series of acoustic resonating chambers, which act to set up interfering resonance and trap the pressure frequencies present.

The use of a muffler of the Maxim type or other to cancel and slow down a pressure pulse can be applied to the present invention as exemplified, such as by FIGS. 5 and 6. Other ways of absorbing or eliminating the disturbance produced by the decrease in pressure below the piston 44 (when an increase in pressure is produced above the piston) can be accomplished by means of silencers or mufflers as described by R. C. Binder in *Advanced Fluid Dynamics and Fluid Machinery,* Prentice Hall, New York, N.Y., 1951, pp. 292–296.

It is important to note that the generation of long-time duration pulses (containing low frequencies in their composition) can be achieved in ways other than by use of very long tubes or by so-called "Maxim Silencers". One such means of absorbing or silencing the counteractive pressure pulse produced below the cylinder of the diaphragm is illustrated in FIG. 11. The diaphragm 44A is supported within the pulser housing 36 and is activated by solenoid 54. The upper surface of diaphragm 44A is exposed to drilling fluid or mud 56. Slideably and sealably received within housing 36 below the diaphragm is a piston 76. The lower surface of piston 76 is exposed to the drilling fluid 56. The area 78 between diaphragm 44A and piston 76 is filled with oil.

Positioned within area 78 is a cylindrical housing 80 supported by a perforated structure 82. Slideable within housing 80 is a piston 84 urged upwardly by spring 86. The area 88 within housing 80 is evacuated or filled with a compressible medium such as an inert gas.

When the MWD instrument containing the structure of FIG. 11 is positioned within a drill string in a borehole, the pressure of drilling fluid on each side of diaphragm 44A will be equalized by the movement of piston 76. Piston 84 will be displaced downwardly in housing 80 as the pressure of the drilling fluid increases, compressing spring 86 and gas in area 88. When a positive pressure pulse is produced by the sudden upward displacement of disphragm 44A, a negative pressure increment will be applied to the oil in area 78. This will cause piston 84 to be displaced upwardly to compensate for this sudden pressure change, thus absorbing a significant portion of the counteracting pressure pulse produced by the diaphragm lower surface. Any substantial pressure change within the fluid in space 78 will be reduced by the displacement of piston 84. The counteracting pressure increment is thus significantly reduced by absorption. The lower portion of housing 36 may connect to a long tube or to a muffler arrangement as previously described to further cancel, delay, or absorb the counteracting pressure increment.

Another variation of my invention is to terminate the long pipe 36A of FIG. 2 in an acoustic dissipatsor that provides an acoustic impedance equal to the "iterative impedance" of the pipe 36A and thus have it behave as though it were infinitely long.

As previously stated, the elongated tube 36A should ideally be equivalent to ¼ wavelength of the representative frequency component of the pressure pulse to be transmitted to the earth's surface to thereby eliminate interfering effect of the counteractive pressure increment produced at the lower surface of the actuated piston or diaphragm. One means of achieving this effective length is to provide a folded telescopic fluid channel pathway within the elongated tube 36A. By this arrangement the sound transmission path can be lengthened without increasing the overall length of the instrument.

With reference now to details shown in FIGS. 2 and 7, the MWD downhole tool of this invention may be eaily inserted into or removed from the drill string 18 by means of a steel cable extending from the earth's surface. As shown in FIG. 2, the upper end of the housing is provided with the male portion 72 of a catcher which releasably receives grasping tool 74 as shown in FIG. 7, attached to the lower end of a cable 76 extending from the earth's surface. Elements 72 and 74 are shown only diagrammatically since such devices are well known in the petroleum industry.

FIG. 8 shows in somewhat more realistic proportions the manner of utilizing the Direct Radiator System of this invention. The drill string portion 18 of FIGS. 2 and 3 is illustrated to be in the form of a special sub 18A and a standard drill collar 18B. The special sub 18A has threaded portions at each end to receive standard drill collars but is typically shorter than a standard drill collar and may, by way of example, be about three feet long. The standard drill collar of a standard 6¾ O.D. drill string has an internal diameter of 2 13/16 inches, whereas the special sub 18A is manufactured to have an enlarged internal diameter of about four inches. This permits the exteral diameter of pulser housing 36 to be enlarged to say 2⅜" while nevertheless permitting ample annular area 56 for the flow of filling fluid therepast. The elongated tubular portion 36A of FIG. 2 has a small outside diameter of approximately 1¾ inches. The sensor 98 of FIG. 8 can be a "directional package" as manufactured by the Develco Company of Sunnyvale, Calif., and the "sub 18C" may be a so-called "bent sub" when directional drilling by use of a mud motor is used. In such cases it is important that the sensor 98 be correctly indexed with respect to the bent sub. For purposes of indexing, the unit 36 of FIG. 8 must maintain a fixed and known angular indexing with respect to the drill collar 18B. This is achieved by the provision of a "Mule Shoe" 38 and indexing pins 36C.

The elongated tubular portion 36A is attached to and supported by pulser housing 36 in dependent fashion and indexes as described above. The elongated tubular housing is of reduced diameter compared to the pulser housing and may be of about 2⅜" O.D., permitting ample annular area therearound for the passage of drilling fluid.

Below the standard drill collar 18B is a box-box sub 18C which receives the drill bit 20.

The lower or reduced diameter housing 36A may include a silencer 90, such as depicted in FIGS. 5 and 6, or of the Maxim Silencer type as previously discussed, or any other arrangement for silencing, delaying, attenuating or otherwise cancelling or reducing the effect of the counter pressure pulses produced by the lower surface of the piston or diaphragm previously described. Openings 92 permit the passage of drilling fluid into the interior of the lower housing portion 36A and the lower end of the pulser housing 36.

In practice the system of my invention can be used:

(a) While drilling and while pumping with the main pumps (provided a sufficiently powerful pressure signal can be generated at the subsurface). In such case the arrangement of FIG. 1 can be employed and the subsurface sensor and pulse generator may operate continuously or upon interrogation.

(b) While pumping with the main pumps but with the actual drilling with the rotary interrupted. Here again the arrangement of FIG. 1 can be employed to operate continuously or when interrogated.

(c) With both the drilling and the main mud pumps interrupted. In such a case the downhole sensor and electronics will be energized and operative only when the circulation of mud has stopped or the output of the sensor can be stored in a downhole memory and interrogated when the main circulation has stopped. In such cases the arrangement of downhole circuitry of FIG. 12 and FIG. 13 can be used.

The arrangement of FIG. 12 provides a means for disconnecting the power supply to sensors and to the telemetering system while drilling is in progress and connecting the power supply to the sensors and to the telemetering system while drilling is temporarily interrupted (by stopping the pump). As shown in FIG. 12, a switch 96B is controlled by mud flow sensor 96A which in turn is actuated by the presence or absence of mud flow as supplied by main pump 22. Instead of a mud flow sensor, a differential pressure sensor or a flow meter can be used. A distinction is made between two time intervals: When the pump is "on" and when the pump is "off". Such systems of actuating, turning on and off, or "interrogation" of the subsurface instrumentation are well known and are described in U.S. Pat. No. 2,924,432 issued to Arps and Scherbatskoy and U.S. Pat. No. 3,896,667 issued to Jeter.

During the first time interval (when the pump is "on") the mud flow sensor 96A maintains the switch 96B "open" and, consequently, the sensor 98 and electronics 96 are deenergized. Thus when drilling is taking place (the pump is "on"), there is no sensing and no telemetering the downhole information to the earth's surface.

During the second time interval (when the pump is "off"), the mud flow sensor 96 maintains the switch 96B in a "closed" position. Consequently, the power supply 94 energizes the sensor 98, electronics 96, and solenoid 54 and the downhole information is obtained and transmitted to the earth's surface.

FIG. 13 shows an arrangement in which means are provided for obtaining and storing the downhole information while drilling is in progress and for transmitting the downhole information to the earth's surface when drilling is temporarily interrupted. As shown in FIG. 13, a memory 96C is provided to store the downhole information. In such case the information generated by the sensor 98 is stored in a binary code or in any other code suitable for computer technology. Here again distinction is made between two time intervals—when the pump is "on" and when the pump is "off".

During the first time interval (when the pump is "on") the mud flow sensor 96A maintains the switch 96B "open"; however, sensor 98, electronics 96, and memory 96C are energized. The electronics 96 contain the necessary encoding devices as, for example, an A-D converter or other types of sequential code pulse generators. The memory 96C retains only the last encoded reading of the sensors. A time element in the electronics 96 periodically cycles through the sensor readings, i.e., every 10–15 seconds (or other suitable time intervals). The electronics 96 takes these updated reading values from the sensors and stores the last value, overriding the previous values.

During the second time interval (when the pump is "off", the mud flow sensor 96 maintains the switch 96B in a "closed" position. Then the last reading value stored in the memory 98C is used to energize the solenoid 54, thus transmitting the derived information to the earth's surface.

Drilling mud pressure signals can readily be transmitted inside the drill pipe of oil well boreholes. Drilling mud is different from ordinary liquids because the viscosity is thixotropic and small bubbles of gas are usually present. In considering attenuation of pressure pulses in mud the thixotropy and compressibility must be given special consideration. In a practical case the attenuation of pressure signals in mud can be estimated as being proportional to:

The first power of the viscosity of the mud.

The second power of the representative frequency in the spectrum of the pulse.

The 3/2 power of the compressibility.

The compressibility of mud is greatly affected by the gas bubbles: 0.01% gas at atmospheric pressure tripples the compressibility and therefore increases the attenuation by a factor of about 5. A presence of 0.1% gas will increase the attenuation by a factor of 150 and 1% gas will increase the attenuation by a factor of about 5000. At greater depths the gas is less compressible, but gas in the mud nevertheless has a major effect on the attenuation.

The "viscosity" of thixotropic mud can be equivalent to several thousand centipoises, and the effect on attenuation is marked when the mud is allowed to "jell".

Long duration pulses will be transmitted very favorably if the proportionality of the second power of the frequency spectrum of the pulse is maintained.

It is noted from the above that introduction of 1% gas and a partial jelling of the mud can increase the attenuation by a factor of several thousand, i.e. similar appearing mud can quickly change from transparency to almost complete opaqueness to pressure pulses.

It is clear from the above that transmission of pressure pulses through the mud column must be made during conditions in which the mud column is under pressure, such as during drilling operations, or very soon after circulation is stopped since gas accumulates in the upper section of the drill pipe very rapidly.

The gas is from several sources:

(a) Some corrosion and electrolysis is constantly occurring in the drill pipe and produces hydrogen.

(b) Air is introduced every time the kelly is connected or a pipe joint is added.

(c) Air introduced by the mud pump and the mud mixing in the pit.

(d) Gas, primarily hydrocarbons, sometimes in large volumes, emanates from formations penetrated by the borehole.

Some gas is in the form of finely divided small bubbles, but some will accumulate into larger bubbles and adhere to the drill pipe at various depths. Under field conditions it can be assumed that the mud is homogeneous inside the drill pipe and that sources of gas (a) will be minor. Air from the sources (b) and (c) as measured with the Baroid gas meter can easily reach 0.2% at atmospheric pressure.

It is important therefore to perform the telemetering operation during the time the mud column in the drill pipe is at superatmospheric pressure or very soon after the pressure has been removed.

It is important to note that the system of this invention, in a practical embodiment, will not generate as powerful a pulse as the systems of the prior art as, for example, described in my co-pending U.S. patent application Ser. No. 110,848. It can be calculated that in the prior system a "pulse" generated at the bottom of the borehole has an effective power of the order of 7 KW and power is applied for about ½ seconds, generating an average energy of about 1 watt hour per pulse. Since in this invention the efficiency of the direct generator is in the order of about 10%, the electrical requirement for the pulse generation is of the order of 10 watt hours per pulse and a practical battery (having an energy of about 1 KWH) could produce only a few thousand pulses before it becomes depleted. It must be noted also that a solenoid or other electromechanical transducer reasonably dimensioned to be employed within a typical oil well drill string usually cannot absorb more than about 1000 watts of electrical power, and therefore, the maximum hydraulic power output of a practical electropulse transducer is only a few watts. This is usually not a sufficiently large amount of power to permit continuous transmission of continuous downhole measurements during the process of drilling the borehole. It is necessary therefore (in many instances) that a lower power pulse will have to be used and the actual transmission of the data be performed intermittently and during cessation of actual drilling while the interferences are reduced.

An important advantage that can be obtained with this system is operation during times when drilling is momentarily interrupted, i.e. at each time when a "joint" of drill pipe is about to be added. Under such circumstances the pumps and the drilling operation are stopped and the "interfering noise" in the drilling mud pressure is reduced practially to zero. With this condition much less powerful pulse signals can override the "noise", and much longer battery life can be achieved. There are, however, some serious problems when drilling is interrupted and the pumps are stopped. Almost immediately after stopping the running of the mud pump 22 the level of the mud in the upper portion of the standpipe 110 and hose 112 in the fluid column will drop to a height "H" above the level of the mud A in the annulus as shown in FIG. 9. When the height of the mud drops to H, the space C above level B within the standpipe and hose is filled with a partial vacuum, air or water vapor. Height H can be about 30 feet for light mud and as low as 20 feet for heavier muds whereas the standpipe 110 is typically more than 50 feet above A, leaving a space of as much as 20 feet which is not filled with mud. The pressure transducer 102 is located on or adjacent the swivel 28 rather than at its normal location on mud piping 26. In order to practice my invention it is important that the swivel be lower than the height H so that the pressure transducer 102 is immersed in drilling mud and that the mud column is uninterrupted from the downhole signal transmitter to the transducer.

The procedure for making measurements with the present invention is as follows, referring to FIG. 9:

1. Drill normally until the top of the kelly 30 is almost down to the rotary table level 16. During this time interval the downhole measurement may be made and stored in a downhole memory 96C (FIG. 13).
2. Stop rotating the drill string.
3. Raise the kelly 30 5 feet to the conditions illustrated in FIG. 9. This raises the bit off the bottom but maintains the pressure transducer 102 below the height B of the mud column.
4. Stop the mud pump 22.
5. Receive the pressure pulses at the pressure transducer 102 located on the swivel 28.
6. Record the pressure pulses in the aboveground equipment memory 104.
7. Raise the kelly 30 and insert slips into the rotary table to hold drill pipe 18.
8. Add a joint of drill pipe and resume normal drilling operations.

After drilling has advanced until the top of the kelly is almost down to the rotary table, repeat the procedure above.

Another problem which may occur when drilling is stopped is illustrated in FIG. 14. This figure is a fragmentary cross-sectional view of the lower end of kelly 30 attached to the upper end of a joint of drill pipe 18 and showing conditions which may occur when the mud pump 22 (see FIGS. 1, 9, and 10) is stopped, such as in preparation for adding a joint of drill pipe. This is a preferred time to take bottomhole measurements by pressure pulses transmitted in the drilling fluid such as by the apparatus of FIGS. 1, 2, and 3. However, FIG. 14 illustrates a condition which may quickly occur when the mud pump is stopped which drastically interferes with taking downhole measurements at this time.

A common practice in the well drilling industry is to employ a mud check kelly valve 109. The function of this valve is to restrain the flow of drilling fluid (mud) out the lower end of the kelly so that when workmen unthread the kelly from the drill pipe 18, so as to be able to insert a new length of drill pipe, mud 56 will not discharge out onto them and onto the rig floor. Thus the mud check kelly valve 109 will pass the flow of mud when pump pressure is applied to the mud flow system but will not pass the flow in absence of pump pressure. For this reason, when the mud pump is stopped, the level of mud 56 in drill pipe 18 may fall while the mud is retained in the kelly. This leaves a void, or air pocket A in the top of the drill pipe 18 below the mud check kelly valve. This void or air gap will cause a severe, if not insurmountable, obstacle to the transmission of pressure pulses from the borehole to the pressure transducer 102 as in FIGS. 1 and 9.

Apparatus and methods to overcome the above problems will now be described with reference to FIG. 10. FIG. 10 shows an arrangement in which drilling fluid is maintained in the entire fluid column when pump 22 is stopped, such as when adding a new joint of drill pipe.

An essential element in this arrangement is an auxiliary mud pump 120 which can be a small centrifugal type.

A precision check valve 112 is interposed between the standpipe 110 and lower pressure piping 114. This low pressure piping can be in the form of a rubber hose 114A since the pressure will never exceed about 200 psi. Two desurgers 116A and 116B (as manufactured by Hydril Co. of Houston, Tex.) are installed in cascade with flow restrictors 118A and 118B. The purpose of these desurgers and flow restrictors is to eliminate almost entirely any pump "noise" from the auxiliary pump 120. Even though the fluid column may slowly leak drilling mud downwardly to cause voids in the fluid column previously described, the addition of a relatively small rate of flow of mud by auxiliary 120 will keep the fluid column and filled with mud, and therefore no air bubble or water vapor will form at the top of the standpipe or below the mud check kelly valve or elsewhere in the fluid column.

The intake of auxiliary pump 120 is connected by piping 126 to the mud pit 24. The auxiliary pump 120 is preferably electrically driven and can run continuously during the drilling and measuring operation. A pressure relief valve 122 connects piping 124 back to the auxiliary pump intake so that a substantially constant pressure of about 50 to 200 psi is applied to the mud in piping 114. A shut-off valve 126 can be closed manually when no measurements are to be made, thus isolating all of the elements 112 through 126 from the mud flow system.

As an illustration that only a small rate of flow of drilling fluid from the auxiliary pump is required, it can be assumed that there are three ½" nozzles in the bit 20 (see FIG. 1). The total area of the throughpath of the downward flow of mud in the fluid column will therefore be through about 0.6 square inches corresponding roughly to a single orifice of about 0.9 inches in diameter. At a head of liquid of 50 feet (that is, the height of the upper end of standpipe 110 above A in FIG. 10) such an orifice will pass approximately 68 gallons per minute and requires about 1 horsepower. In addition to the resistance of flow of the bit jets, there is the resistance to flow of the long drill pipe which further reduces the horsepower required to drive auxiliary pump 120. Thus, auxiliary pump 20 and the motor which drives it can be relatively inexpensive items cf equipment and economical to operate.

It is important to note that "gas" (i.e. air, water vapor, etc.) had an enormous effect on the pulse transmission characteristics of the drilling mud. The degree of attenuation of the pulse signal is affected at least directly (and probably by an exponent greater than 1) proportional to the compressibility of the drilling fluid. As has been pointed out above, 0.1% of gas in the mud increases the attenuation factor a factor over 100. Gas escapes into the drilling mud almost immediately upon removal of mud pump pressure. The application of a pressure of only a few hundred psi employing the auxiliary pump in the arrangement of FIG. 10 reduces the effect of gas considerably.

An important feature of my invention relates to directional drilling. When the "bent sub" is used for directional drilling to deviate the borehole, it is necessary to have knowledge of the direction at which the drill bit is facing. This direction is the same as the direction at which the "bent sub" or "tool face" is pointing and is the same as the direction of the axis around which the mud motor is rotating. Such direction can be measured with respect to appropriate one, two or three references axes and is known in the industry as the "tool face angle". The tool face angle will be expressed by a symbol A which may represent one, two or three angular values. These angular values depend upon the orientation of the corresponding reference axes.

During drilling various extraneous effects occur which tend to change the tool face angle from its assigned value A to a different value $A+\Delta A$. I shall now describe a procedure for minimizing or substantially nullifying the value $\Delta A$ so as to maintain the tool face aligned along the preassigned direction.

One of the main factors which accounts for $\Delta A$ is the twisting of the drill string. Such twisting is caused among other things by the varying torque applied to the mud motor while drilling. Generally the upper part of the drill string 18 is prevented from turning by clamping the rotary table 16.

Let B designate angular position of the upper part of the drill string 18 which is the angular position of the turntable 16 with respect to a selected reference direction in the horizontal plane. The angle B is of particular significance to the driller since by varying B (i.e., by varying the angular position of the turntable 16) the driller is capable of controlling the tool face angle A. Accordingly, I shall designate the angle B as the "input angle B". Let also C designate the angular position of the drill string 18 at its lowest part adjoining the mud motor and the bit. The angular position C will be measured with reference to a selected direction in the plane perpendicular to the drill string at said lowest point of said drill string.

Because of rotation of the mud motor, the angular position C will be different from the angular position B. The angle of twist T will be defined as $$T=C-B \tag{1}$$

As noted above, the angular orientation of the drill bit (i.e., the tool face angle A) can be controlled by the driller by varying the input angle B. However, the driller should also take into account the angle of twist T as defined in (1). The relationship between B, A, and T can be expressed symbolically as $$B=F_1(A,T) \tag{2}$$

which shows that in order to maintain the tool face at the assigned orientation A the driller should know the value of the twist angle T in order to impart to the rotary table an appropriate angular displacement B.

The relationship (2) can also be expressed as $$A=F_2(B,T) \tag{3}$$

which shows explicitly how the tool face angle A depends on the input angle B and the twist angle T.

It is well known that because of the varying load the twist angle may change from its initial value T to a new value $T+\Delta T$ while the angular position of the turntable 16 remains at its initial value B. Then in accordance with the relationship (3) the tool face angle assumes a new value $A+\Delta A$ expressed as $$A+\Delta A=F_2(B,T+\Delta T) \tag{4}$$

It is, however, desirable or even necessary to minimize or substantially nullify $\Delta A$ in order to maintain the inclined drilling at a preassigned course. This can be accomplished by the driller by changing the angular displacement of the rotary table 16 from a previous value B to a new value $B+B$ so as to satisfy the relationship $$A=F_2(B+\Delta B,\ T+\Delta T) \tag{5}$$

The discussion outlined above will now be considered in two different situations: (1) When the downhole information is telemetered to the earth's surface while drilling is in progress (i.e. the pumps are "on" and the mud is flowing) and (2) when the downhole information is telemetered to the earth's surface while drilling is interrupted (i.e. the pumps are "off" and the mud is quiescent).

Case 1

Telemetering While Drilling

The appropriate arrangement is a modification of FIG. 12 in which the mud flow sensor 96A is non-existent and the switch 96B is permanently closed, thus ensuring a continuous supply of power from the power supply 94 to the sensor 98, electronics 96, and solenoid 54. In such a modified arrangement of FIG. 12 both the sensor and the telemetering system are continuously operative while drilling is in progress.

It is apparent that since the loading on the bit is changing and as the drill string is twisted along its axis by the reaction to the loading, it is necessary to vary the angular displacement of the rotary table in order to compensate for the twist and thus maintain the tool face angle at its preassigned value. In other words, since T varies by the reaction of the loading it is necessary to vary appropriately the input angle B so as to maintain A at its assigned value. An arrangement for accomplishing this purpose is illustrated in FIG. 21.

FIG. 21 shows equipment located at the earth's surface, including a computer 300 provided with input terminals 301, 302, and an output terminal 303. The pressure transducer 102 (as in FIG. 1) generates a succession of coded electrical pulses representing the tool face angle. These pulses are transmitted through an amplifier 103 to a decoder 106, thus providing a signal rerpesenting the tool face angle A, which signal is applied to the input terminal 301 of the computer 300.

A twist indicator 310 is provided for generating a signal representing the angular first T, said signal being applied to the input terminal 302 of the computer 300. The computer is programmed to perform calculations as indicated by the relationship (2). Thus the computer is arranged to receive quantities A and T from the input terminals 301 and 302, respectively, and generates at its output terminal the quantity B. A display element 311 is provided which indicates visually to the driller the input angle B which is required in order to maintain the tool face angle at its preassigned orientation.

An important element in the arrangement of FIG. 21 is the twist indicator 310. Generally speaking, the angle of first T is a function of a number of variables such as the standpipe pressure, the torque at the rotary, the weight on the bit, the length of the drill pipe, strength of the drill pipe and of other variables. Under some conditions the problem can be simplified. It can be then assumed that the angle of the twist depends solely on the mud pressure, or on the torque at the rotary table.

Assume now that the angle of the twist is solely dependent on mud pressure. When drilling with a mud motor, a substantial fraction of the drilling mud pressure (as indicated by the pressure transducer 102) is used to rotate the mud motor, and the torque by the mud motor is directly proportional to the fluid pressure across it. A fraction of the mud pressure indicated by the pressure transducer 102 is used to move the drilling mud down the drill string. Thus $$P_T = P_s + P_m \tag{6}$$

where $P_T$ is the total pressure measured by the transducer 102, $P_s$ is the pressure necessary to move the mud stream down the drill hole, and $P_m$ is the pressure needed to turn the mud motor. Since $P_s$ does not vary very much for a given depth, one can assume that $P_s = K_1$, where $K_1$ is a known constant. It can also be assumed that $P_m$ is proportional to torque, i.e., $P_m = K_2 N_1$ where $N_1$ is the torque at the rotary table and $K_2$ is a known constant. Thus $$P_T = K_1 + K_2 N_1,$$

and consequently $$N_1 = (1/K_2)(P_T - K_1) \tag{7}$$

It can be assumed that the twist angle T (which one desires to determine) is proportional to $N_1$ $$T = K_3 N_1$$

where $K_3$ is a constant.

The torque at the rotary table can be of the type described in any of the following patents: U.S. Pat. Nos. 3,295,367 issued Jan. 3, 1967 to H. A. Rundell; 3,581,564 issued June 1, 1971 to F. S. Young, Jr.; 3,703,096 issued Nov. 21, 1972 to A. L. Vitter, Jr. et al, and 3,906,434 issued Sept. 16, 1975 to A. E. Lamel et al. All these patents are specifically incorporated into this specification by reference.

In addition to the procedures hereinabove described I have provided a different procedure for maintaining the tool face angle constant at a predetermined value. This can be explained as follows:

When drilling for the "initial kick-off" (i.e. the first deviation from the vertical) the drill pipe is "hanging free" since much of it is inside the surface casing and the drill pipe friction against the well wall is minimal (sometimes almost zero).

In this case the torque at the rotary table is very nearly equal to the torque at the bit and, therefore, the torque at the rotary can be said to be proportional to the angle of twist. If we maintain the torque at the rotary constant, the angle of twist will be constant.

Rotary torque meters are commercially available and are installed on many modern practical rigs. Arrangements for maintaining automatically a constant torque on the rotary table are well known in the art.

Case 2

Telemetering While Drilling is Interrupted

The required procedure for an effective control of the tool face angle will now be explained with reference to the schematic arrangement of FIG. 13. An initial time interval I and a subsequent time interval II will now be considered.

During the initial time interval I the drill string (including bit, mud motor, bent sub, and telemetering system) is lowered into the borehole. The drill string is allowed to hang free with the bit off bottom. The mud pump is off, and the mud floor sensor 96A maintains the switch 96B in a "closed" position. Consequently the telemetering system is adapted to transmit the downhole information to the top of the borehole. The particular information one is interested in is the tool face angle. Accordingly the sensor 98 provides the driller with the value of the tool face angle when the drill string has been lowered into the borehole. This value is generally speaking different from the particular value A of the tool face angle which the driller wishes to assign since the twist of the string should be taken into account. The value of the tool face angle can be controlled by the driller by rotary table 16. In order to determine the appropriate value B of the angular displacement of the rotary so that the tool face angle will assume the assigned direction it is necessary for the driller to make an estimate of the twist angle T which will occur when the drilling operation is resumed. Once such an estimate is made the driller determines the input angle B from the relationship (2) and rotates the rotary table accordingly. Subsequently the driller initiates the drilling procedure which lasts during the time interval II.

Accordingly the driller lowers the drill string to the bottom, applies weight and starts drilling. Since the mud pump is "on" the switch 96B in FIG. 13 is open, thus isolating the solenoid 54 and the rest of the telemetering equipment from the sensor 98, power supply 94, electronics 96, and memory 96C. However, during this period (i.e. while drilling), the sensor 98 measures the tool face angle, and these measurements are impressed on the memory 96C. During this period there is a torque applied to the mud motor which turns the bit pressing against the formation. This causes a twist of the drill string, and this twist may have a value $T+\Delta T$ which is different from the value T previously estimated by the driller. Consequently, referring now to the equation (4) it can be seen that the tool face angle has now a value $A+\Delta A$ where $\Delta A$ represents an undesired departure from the assigned value A. This value $A+\Delta A$ is introduced into the memory 96C.

After an appropriate time interval which may last a few minutes the drilling is stopped. Since the pump is "off", the switch 96B is actuated, thus connecting the memory 96C to the solenoid 54, thereby transmitting to the earth's surface the value $A+\Delta A$. At that time the driller observes the value $A+\Delta A$ and accordingly modifies the input angle B so as to reduce $\Delta A$ to zero.

Downhole measurements can be made under three conditions, that is: (a) during drilling and with the mud running, which is the maximum noise conditions; and (b) while drilling is stopped, but while the mud pump is running, the intermediate noise condition; and (c) with drilling stopped and the mud pump not running, the least noise condition. Methods of making measurements during conditions (c) have been described. Referring now to FIGS. 15 through 20, apparatus and methods will be described for use at the surface of the earth for reducing the effect of noise when downhole measurements are performed during conditions (a) and (b).

In such cases the useful signal representing the downhole measurement is accompanied by noise. A particular arrangement for attenuating noise due to the operation of the mud pump 22 is shown in FIGS. 15 through 20.

FIG. 15 shows typical aboveground equipment in accordance with a preferred embodiment of the invention, wherein the downhole parameter being sensed is the radioactivity of formations traversed by the bore while drilling is in progress. The corresponding portion of the logging equipment which is below the earth's surface is in the form of a geiger counter and scaling circuit (not illustrated). The output of the scaling circuit operates the solenoid 54 of FIG. 2.

Referring now to FIG. 15, pressure transducer 102 connected to the standpipe 110 converts the variation of mud pressure within the standpipe into a varying electrical voltage. This voltage represents a mixture of two component signals—the useful, information carrying signal and the interfering signal. The inforamtion carrying signal is a succession of short mud pressure pulses produced by the downhole equipment (pulse generator). The interfering signal is in the form of relatively slow and periodic pressure variations which are generated by the strokes of the mud pump 22. These mud pump signals tend to mask or obscure the information one desires to obtain by utilizing the short mud pressure pulses.

One of the objectives of this invention is to recover from the "contaminated" signal produced by the transducer, a "clean" signal which gives the desired information. This is accomplished by means of a signal extractor 202 which is applied to the output terminal 201 of the pressure transducer 102. The signal extractor eliminates the interfering effects and produces across its output terminal 208 a succession of pulses from which the information regarding the downhole parameter can be readily obtained.

The signal extractor 202 is controlled in a predetermined manner by a succession of timing pulses obtained from a pulse generator 211 and applied to the control terminals 213, 214. The pulse generator 211 is mechanically driven by the mud pump 22 to produce an appropriate number of timing pulses per revolution of the pump. A chain drive transmission assembly 212 is provided for this purpose.

The "clean" information carrying signal obtained from the extractor 202 is in the form of pulses derived from the actuation of the solenoid 54 of the direct radiator described with reference to FIGS. 1 through 7. The relevant information is provided by the time intervals separating the pulses. A time-to-amplitude converter 215 connected to the signal extractor output terminal 208 converts these pulses derived from the actuation of the solenoid 54 into signals having magnitudes representing the intervals therebetween. The converter 215 is a well known electronic device and can be made up of components manufactured by the Burr-Brown company of Tuscon, Ariz. U.S.A. For further detailed description of time-to-amplitude converters see: M. Bertolaccini and S. Cova, "*Logic Design of High Precision Time to Pulse Height Converters*", Nuclear Instruments and Methods 121 (1974), pp. 547–566, North Holland Publishing Co.

The signals derived from the converter 215 are in turn applied to the input terminal 209 of a reciprocation circuit 218. The reciprocation circuit 218 (as, for example, manufactured by Analog Devices, Inc. of Norwood, Mass.) produces output voltages which are the reciprocals of the input voltages. Thus, if a voltage of magnitude M is applied to reciprocation circuit 218, an output voltage having magnitude 1/M is obtained. These signals having magnitudes 1/M are in turn recorded on the chart of a recorder 108. The record chart of recorder 108 is moved in correlation with changing depth of the downhole sensor unit by a depth sensing device 221. The depth sensing device may be, for example, a modification or adaptation of equipment such as marketed by The Geolograph Medeavis Company of Oklahoma City, Okla. U.S.A.

In order to show more clearly the operating features of the signal extractor 202, we will analyze the behavior of the various signals which are involved. They are shown schematically in a simplified and idealized form as they vary with time in FIG. 16. Let $$F(t)=S(t)+N(t) \tag{1}$$

where S(t) is the useful information carrying signal formed by the mud pressure pulses $P_1$, $P_2$, and $P_3$ aligned along the time axis t. [See FIG. 16 (axis A)] The times of arrival of these pulses, which correspond to the times of actuation of the solenoid 54 of the director radiator downhole device of FIGS. 1 and 2, are $t_1$, $t_2$ and $t_3$, respectively. The time intervals which separate these pulses are $\lambda_1=t_2-t_1, \lambda_2=t_3-t_2$, $\lambda_3=t_4-t_3$, etc. are indicative of the intensity of the radiation measured. If these time intervals are large, the intensity is relatively weak and conversely, if they are small, the intensity is relatively strong. The interfering signal produced by the mud pump 22 is represented in FIG. 16 (axis A) by a periodic but not necessarily sinusodal function N(t) having a period T. The length of the period is related to the speed of rotation of the pump 22.

To facilitate explanation, the relative scales in FIG. 16 have been distorted. In actual practice, there may be 50 to 80 oscillations of N(t) between the times of arrival of $P_1$ and $P_2$. Thus, $\lambda_1$ and $\lambda_2$ may vary from 50T to 80T. However, in FIG. 16 (axis A) only a few oscillations of N(t) between $P_1$ and $P_2$ have been shown. Furthermore, in actual practice the negative mud pressure pulses $P_1$, $P_2$, $P_3$ do not have clean rectangular forms as in FIG. 16 (axis A). Moreover, the actual pulses are much smaller than those which have been shown in FIG. 16 (axis A). The magnitude of $P_1$, $P_2$ or $P_3$ is about 0.1 to 0.01 of the maximum amplitude of the pulsations N(t).

Axes A-E in FIG. 16 are positioned one below the other so that one can compare the signals in their time relationships one to another. Using these figures, we can now enumerate the instrumental steps which are involved in the operation of the signal extractor 202. These are as follows:

Step 1 We displace the input F(t) by an amount T, to obtain $$F(t-T)=S(t-T)+N(T-T) \tag{2}$$

where S(t−T) and N(t−T) are, respectively, the displaced, useful signal and displaced interfering signal. Both signals are shown in FIG. 16 (axis B). The signal S(t−T) is represented by pulses $P_1^{(a)}$, $P_2^{(a)}$ and $P_3^{(a)}$ which have been obtained by displacing by an amount T the corresponding pulses $P_1$, $P_2$ and $P_3$ in FIG. 16 (axis A). The signal N(t−T) in FIG. 16 (axis B) is shown to be in exact synchronism with N(t) in FIG. 16 (axis A). This is due to the periodicity of the signal. Thus, $$N(t-T)=N(t) \tag{3}$$

Step 2 We subtract the displaced input function F(t−T) from the original input function F(t) to obtain $$M(t)=F(t)-F(t-T) \tag{4}$$

Taking into account (1), (2) and (3), we obtain $$M(t)=S(t)-(T-T) \tag{5}$$

Thus, the interfering signal has been eliminated and does not appear in M(t). This can also be seen from inspection of FIG. 16 (axes A and B).

As shown in FIG. 16 (axis C), M(t) consists of impulses which occur in pairs. Each pair contains a negative and a positive pulse separated one from another by a time interval T. Thus, we observe a pair consisting of $P_1^{(b)}$ and $P_1^{\overline{(b)}}$ which is followed by a succeeding pair consisting of $P_2^{(b)}$ and $P_2^{\overline{(b)}}$, then by another pair consisting of $P_3^{(c)}$ and $P_3^{\overline{(c)}}$ and so on.

Step 3 We displace M(t)by a time T so as to obtain M(t−T) Thus, the entire sequence of pulses in FIG. 16 (axis C) is shifted along the time axis by T so as to appear as shown in FIG. 16 (axis D). The arrangement of pulses as in pairs has been preserved in FIG. 16 (axis D). However, each pair such as $P_1^{(c)}$ and $P_1^{\overline{(c)}}$ is displaced with respect to the pair $P_1^{(b)}$ and $P_1^{\overline{(b)}}$ [shown in FIG. 16 (axis C)] by T. Similarly, the pair $P_2^{(c)}$ and $P_2^{\overline{(c)}}$ is displaced with respect to the pair $P_2^{(b)}$ and by $P_2^{\overline{(b)}}$ T, and so on.

Step 4 We compare the displaced pulses in FIG. 16 (axis D) with those in FIG. 16 (axis C). We note that some of these in FIG. 16 (axis D) are in time coincidence with some of the pulses in FIG. 16 (axis C). The instances at which coincidence occurs are recorded in FIG. 16 (axis E) as pulses $P_1^{(d)}$, $P_2^{(d)}$ and $P_3^{(d)}$. Thus, $P_1^{(d)}$ coincides with $P_1^{\overline{(b)}}$ and $P_1^{(c)}$ $P_2^{(d)}$ coincides with $P_2^{\overline{(b)}}$ and $P_2^{(c)}$ $P_3^{(d)}$ coincides with $P_3^{\overline{(b)}}$ and $P_3^{(c)}$ The times at which the pulses $P_1^{(d)}$, $P_2^{(d)}$ and $P_3^{(d)}$ occur are $t_1+T$, $t_2+T$ and $t_3+T$.

The pulses $P_1^{(d)}$, $P_2^{(d)}$ and $P_3^{(d)}$ correspond to the pulses $P_1$, $P_2$ and $P_3$ shown in FIG. 16 (axis A). Consequently, the pulses in FIG. 16 (axis E) also represent this useful function which now is S(t-T) since it has only been displaced by T. It is evident that the pulses in FIG. 16 (axis E) provide the information which we are seeking to obtain. The time interval between $P_1^{(d)}$ and $P_2^{(d)}$ is $\lambda_1$, and the time interval between $P_2^{(d)}$ and $P_3^{(d)}$ is $\lambda_2$, etc. The quantities $\lambda_1$, $\lambda_2$, etc. are are indicative of the radiation measured by the gamma ray detector.

The above steps will now be considered as they relate to the performance of the signal extractor 202 and more particularly to that of its two component parts designated in FIG. 15 as 205 and 207 and shown schematically in FIGS. 17 and 18, respectively.

The component 205 receives at its input terminal 201 (which is the same as that of the signal extractor 202 of FIG. 15) the signal F(t). As shown in FIG. 17, this signal is transmitted through an amplifier 230 to the input terminal 231 of a delay network 232. The delay network delays F(t) by T, thus producing at its output terminal 234 the signal F(t-T). This signal is a sum of two component signals S(t-T) and N(t-T) which are shown in FIG. 16 (axis B).

The signal F(t-T) is applied to one input terminal 234 of a subtracter 235. The other input terminal 236 of the subtracter receives directly the signal F(t), which is transmitted from terminal 201 by means of conductor 237. Thus, at the output terminal 206 of the subtracter 235 we obtain the difference signal M(t)=F(t)−F(t−T). This is shown in FIG. 16 (axis C).

The delay network 232 is provided with control terminal 213 which receives a signal controlling the delay T. It is important that the length of the delay T be the same as the period of mud pressure oscillations produced by the mud pump 22.

The amount of the delay T is controlled by the timing pulses derived from pulse generator 211 shown also in FIG. 15 and applied via conductor 210 to the control terminal 213. It is noted that the delay T is the same as the period of oscillation of mud pressure produced in the successive strokes of the mud pump 22. Consequently, the frequency of these timing pulses must be controlled by the rotation of the pump.

Assume that the pump produces $N_1$strokes per second. Thus, $T=1/N_1$. The pulse generator 211 produces timing pulses at a relatively high rate $N_2$, which is a multiple of $N_1$. Thus, $N_2=KN_1$, where K is a constant which has been chosen to be 512. Thus, if the strokes of the pump are one per second this would require the signal generator to produce 512 pulses per second. It is apparent that the rate of pulsation of the mud pump 22 varies with time and, accordingly, $N_2$ will vary so as to ensure that the delay produced by delay network 232 will always be equal to one period of the mud pressure oscillations produced by the mud pump 22.

The delay network 232 which is controlled, as described above, may be a Reticon Model SAD-1024 Dual Analog Delay Line as marketed by Reticon Corporation, Sunnyvale, Calif. U.S.A.

The instrumental steps herebefore described are the steps 1 and 2 performed by the component 205 of the signal extractor 202. We have transformed the input signal F(t) [represented by its components in FIG. 16 (axis A)] into an output signal M(t) which appears as a succession of pairs of pulses and is shown in FIG. 16 (axis C). We will now proceed to describe further instrumental steps which are required in order to accomplish the desired objectives. These are performed by the component 207 of the signal extractor 202.

We refer now to FIG. 18. The signal M(t) is now applied through conductor 240 to a delay network 241. This delay network is identical to that designated as 232 in FIG. 17. It receives, at its control terminal 214, the same control signal which was applied to the control terminal 213 of the delay network 205. Consequently, the amount of delay produced by delay network 241 is T and the signal appearing at the output of 241 is M(t-T) as shown in FIG. 16 (axis D). This output signal is transmitted through an amplifier 243 to one input terminal 245 of an AND gate 246. At the same time, the undelayed signal M(t) is applied through the conductor 247 and amplifier 248 to the other input terminal 249 of the AND gate 246. These two input signals M(t) and M(t-T) which are applied to the AND gate 246 are shown in FIG. 16 (axes C and D), respectively. We have previously observed that some impulses shown in FIG. 16 (axis C) occur in coincidence with impulses in FIG. 16 (axis D). Those impulses that occur in coincidence appear in the output of the AND gate 246. They are designated in FIG. 16 (axis E) as $P_1^{(d)}$, $P_2^{(d)}$ and $P_3^{(d)}$. These coincident pulses are the output of pulses of the component 207, and consequently of the signal extractor 202 .

It is thus apparent that by means of the component 207 we have performed the instrumental steps 3 and 4. We have transformed the signal M(t) shown in FIG. 16 (axis C) into the signal S(t-T) shown in FIG. 16 (axis E). The latter provides the quantities $\lambda_1$, $\lambda_2$, $\lambda_3$, etc., which represent the information it was desired to obtain. It should be recalled that the signal S(t-T) is represented by a succession of pulses as shown in FIG. 15 (axis E). These pulses are transmitted to the time-to-amplitude converter 215 to produce at the output of the time-to-amplitude converter 215 signals of various magnitude such as $\lambda_1$, $\lambda_2$, $\lambda_3$, etc. that represent time intervals between the arrival of pulses. These signals are in turn fed to and transformed by the reciprocation circuit 218 of FIG. 15 into reciprocal signals having magnitudes $1/\lambda_1$, $1/\lambda_2$, $1/\lambda_3$, respectively. These reciprocal signals are recorded by recorder 108 of FIG. 15. It is apparent that the quantities $1/\lambda_1$, $1/\lambda_2$, $1\lambda_3$ represent the intensity of radioactivity of formations sensed by the downhole sensor unit at various depths in the borehole.

We have described above an instrumental means for performing logical steps leading from the function F(t) to a function S(t-T). These steps have been performed by representing these functions in an analog (non-digital) form. Alternatively, if desired, the entire process can be digitalized, as shown diagrammatically by FIG. 19. In FIG. 19, the output of the pressure transducer 102 is fed to an analog-to-digital converter 203, the output of which is fed to a digital computer 204. The operations indicated in FIG. 19 are performed by the elements designated 222, 223, 224, 225 and 226 in the digital computer 204. Timing signals from a pulse generator 211 are introduced to the digital computer 204 in order to control the delays in accordance with the pump speed. The operations indicated in the dotted rectangle of FIG. 19 are performed mathemetically in a sequence which may be flow charted. The output of the computer z04 is fed to a digital-to-analog converter 227, the output of which is fed to the recorder 108.

In FIG. 20, there is shown an arrangement similar in some respects to that of FIG. 15, but but wherein the data to be obtained and recorded are the temperature at the location of sensor unit 96 of FIG. 2. These data, as presented to the signal extractor 202 are in digital form. The signal extractor 202 of FIG. 20 is identical to that of FIG. 15, but the time-to-amplitude converter 225 and the reciprocation circuit 228 of FIG. 15 are replaced by a digital-to-analog converter 241. The output signals of the pulse generator 211 will be applied to the control terminal 210 of the signal extractor 202.

The equipment and methods of FIGS. 15 through 20, as described, can be employed to more effectively extract pressure signals detected at the earth's surface by the pressure transducer 102 as transmitted by the direct radiator apparatus described with reference to FIGS. 1 through 9 noise conditions, that is, when mud pump 22 is running when drilling is stopped or when drilling is proceeding. Thus the invention provides improved means of transmitting information from a borehole by pressure signals in the fluid column and improved means of detecting pressure signals at the earth's surface during various conditions of drilling operations.

Throughout this specification the apparatus for actuating piston 44 and diaphragm 44A has been illustrated and described as solenoid 54. Obviously other types of actuating devices may be employed, such as a motor.

If piston 44 or diaphragm **44*a* is moved upwardly at a velocity exceeding the speed of sound transmission of the drilling fluid 56*a*** shock wave will be produced. While the production of a shock wave requires more energy than a normal sonic pressure pulse, in some instances the advantages of the use of shock wave pressure pulses justify the expenditure of this additional energy.

The disclosures described in connection with FIG. 8 and FIG. 15 to FIG. 20 have been discussed more in detail in the above-referred to application, Ser. No. 110,848, filed by Serge A. Scherbatskoy, of which the present application is a continuation-in-part.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. For use in conducting drilling operations employing a string of drill pipe extending from the earth's surface having a drilling means at the lower end and a column of drilling fluid within the drill string, a telemetering system comprising:

a housing forming a portion of a drill string providing for the flow of drilling fluid therepast;

means carried by said housing for detecting the magnitude of a downhole parameter and for producing a succession of electrical signals representing said magnitude;

means carried by said housing for producing discrete code formatted increments of fluid pressure change in the drilling fluid column irrespective of the flow of drilling fluid in response to said electrical signals thereby producing pressure variations which are propagated to the earth's surface; and means at the earth's surface to detect such pressure variation and to provide a measure of the magnitude of said parameter.

2. A telemetering system according to claim 1 wherein said housing is in the form of a tubular member of external diameter less than the internal diameter of the drill string in which the housing is positioned, and wherein said means for producing increments of pressure is a reciprocally actuated means positioned within said tubular member.

3. A telemetering system according to claim 2 wherein said reciprocally actuated means is a piston.

4. A telemetering system according to claim 2 wherein said reciprocally actuated means is a diaphram.

5. A telemetering system according to claim 2 wherein said reciprocal means is actuated by a solenoid means.

6. A telemetering system according to claim 1 wherein said housing is formed at least in part by an elongated tubular member of external diameter less than the internal diameter of the drill string in which the housing is positioned, the effective length of the tubular member being a selected fractional multiple of the wavelength of the major frequency component of the pressure (pulses) variations produced by said pressure increments producing means.

7. A telemetering system according to claim 6 wherein said fractional multiple defining the length of said tubular member is $\frac{1}{4}$.

8. A telemetering system according to claim 1 in which said housing is retrievable from within said string of drill pipe by means supported to a cable extending from the surface.

9. A telemetering system according to claim 1 in which said housing is positionable at an operating location within said string of drill pipe by means supported to a cable extending from the surface, the cable being removable after the housing is positioned.

10. A telemetering system according to claim 1 wherein said means for producing localized increments of fluid pressure changes in the column of drilling fluid includes means or producing shock waves.

11. A telemetering system according to claim 1 wherein said means for producing increments of fluid pressure changes comprises:

a displaceable member exposed to the column of drilling fluid and having first and second surfaces;

means of rapidly displacing said member to create pressure increments at said first and second surfaces of opposite polarity;

means of coupling said pressure increments at said first surface with said fluid column for transmission as pressure pulses to the earth's surface; and means of attenuating said pressure increments at said second surface to minimize interference with said transmitted pressure pulses.

12. A telemetering system according to claim 11 wherein said means of attenuating said pressure increments includes a tubular attenuation member extending from said housing and communicating with said displaceable member second surface to receive pressure increment changes therefrom.

13. A telemetering system according to claim 12 wherein said tubular member communicating with said displaceable member second surface is of a length equivalent to $\frac{1}{4}$ the wavelength of the major frequency component of said first surface pressure increment changes.

14. A telemetering system according to claim 11 wherein said means of attenuating said pressure increment changes at said second surface includes muffler means.

15. A telemetering system according to claim 11 wherein said means of attenuating said pressure increment changes at said second surface includes silencer means.

16. A system for telemetering from the bottom of a borehole to the surface of the earth by borehole fluid pressure pulses irrespective of the flow of borehole fluid, comprising;

(a) an electrically driven member located near the bottom of said borehole and immersed in said fluid;

(b) means for displacing said member in a manner indicative of the value of a downhole parameter, each displacement generating first fluid pressure increments of one polarity on a first side of said member and second fluid pressure increments of opposite polarity on the opposite side of said member, said first and second pressure increments occurring in approximate time coincidence and tending to cause pressure increments cancellation effects, said first fluid pressure increments being transmitted directly to said borehole fluid;

(c) fluid pressure increment delay means coupled to said second side to delay the time of transmission of said second pressure increments to said borehole fluid and thus to reduce said cancellation effects; and (d) means at the earth's surface to detect the pressure increments produced by said first side.

17. A telemetering system for transmitting measurements from within a borehole to the earth's surface employing, as a transmitting medium, a drilling fluid column contained in a drill string, comprising:

means carried by the drill string for detecting the magnitude of a downhole parameter and for producing an electrical signal representing said magnitude;

self contained means independent of extraneous energy source carried by the drill string and irrespective of the flow of drilling fluid for producing code formatted fluid pressure changes in the drilling fluid column in response to said electrical signal, thereby producing pressure variations which are propagated; and means at the earth's surface to defect such pressure variations and to provide a measure of the magnitude of said parameter.

18. A telemetering system according to claim 17 wherein the fluid column has a longitudinal axis and wherein said means of producing fluid pressure changes in the drilling fluid column includes:

an impermeable member in communication with the fluid column; and means to rapidly move said impermeable member parallel the fluid column longitudinal axis.

19. A telemetering system for transmitting measurements from within a borehole to the earth's surface employing, as a transmitting medium, a drilling fluid column contained in a drill string, comprising:

means carried by the drill string for detecting the magnitude of a downhole parameter and for producing an electrical signal representing said magnitude;

means carried by the drill string for producing discrete code formatted fluid pressure changes operational in both flowing and static drilling fluid in the column in response to said electrical signal, thereby producing pressure variations which are propagated; and means at the earth's surface to detect such pressure variations and to provide a measure of the magnitude of said parameter.

20. For use in conducting drilling operations employing a string of drill pipes, some of which may be drill collars, extending from the earth's surface having a drilling means at the lower end, and a column of drilling fluid within the drill string, a telemetering system using a housing positioned within said drill string, means carried by said housing for producing an electrical signal representing the magnitude of a downhole parameter, means carried by said housing for producing increments of fluid pressure change irrespective of the flow of drilling fluid in response to said electrical signal thereby producing pressure variations which are propagated in said column of drilling fluid, said system comprising:

a displaceable member having a first surface coupled to said drilling fluid, said displaceable member having a second surface;

means of rapidly displacing said member to create pressure increments at said first surface;

means of communicating said pressure increments at said first surface with said fluid column for transmission as pressure variations to the earth's surface;

means for substantially nullifying the coupling of said second surface to said drilling fluid; and means at the surface of the earth for detecting said pressure variations and for providing an indication of the value of said parameter.

21. A system for telemetering from the bottom of a borehole to the surface of the earth by pressure waves in a borehole fluid column, irrespective of the flow of fluid in the column said system comprising:

pulse generating means immersed in said fluid column, the pulse generating means having a movable member, said movable member having two sides;

means for displacing said movable member in a manner indicative of a value of a downhole parameter;

means for coupling one side of said movable member to said fluid column to produce pressure waves in said fluid column in response to pressure increments on one of said sides of said movable member; and means at the earth's surface to detect said pressure waves responsive to said pressure increments on said one side of said movable member.

* * * * *